US008757398B2

(12) United States Patent
Letinic et al.

(10) Patent No.: US 8,757,398 B2
(45) Date of Patent: Jun. 24, 2014

(54) DISPLAY SYSTEM

(75) Inventors: Ivan Letinic, Manalapan, NJ (US); Joseph Roan, Media, PA (US); Robert Leavens, Medford, NJ (US)

(73) Assignee: Art Guild, Inc., Thorofare, NJ (US)

( * ) Notice: Subject to any disclaimer, the term of this patent is extended or adjusted under 35 U.S.C. 154(b) by 283 days.

(21) Appl. No.: 12/904,386

(22) Filed: Oct. 14, 2010

(65) Prior Publication Data

US 2011/0303624 A1 Dec. 15, 2011

Related U.S. Application Data

(60) Provisional application No. 61/251,537, filed on Oct. 14, 2009.

(51) Int. Cl.
*A47F 7/16* (2006.01)
*A47F 7/00* (2006.01)

(52) U.S. Cl.
CPC ..... *A47F 7/0042* (2013.01)
USPC ..... 211/45

(58) Field of Classification Search
USPC ..... 211/45, 41.11, 41.13, 41.15, 41.14, 48, 211/47, 41.1, 46, 55, 52, 40, 193; 108/108, 108/134, 135, 193
See application file for complete search history.

(56) References Cited

U.S. PATENT DOCUMENTS 1,367,817 A * 2/1921 Keller ..... 211/6
2,865,513 A * 12/1958 Allen ..... 211/41.14
3,138,261 A * 6/1964 Witteborg ..... 211/41.1
3,534,863 A * 10/1970 Howard ..... 211/47
3,598,066 A * 8/1971 Polezoes et al. ..... 108/187
4,040,588 A * 8/1977 Papsco et al. ..... 248/245
4,091,933 A * 5/1978 Alexander ..... 211/204
4,119,207 A * 10/1978 Fuller et al. ..... 211/45
4,197,950 A * 4/1980 Ovitz, III ..... 211/134
4,242,970 A * 1/1981 Suttles et al. ..... 108/159
4,256,043 A * 3/1981 Ovitz, III ..... 108/29
4,604,061 A * 8/1986 Willcocks et al. ..... 434/74
4,791,873 A * 12/1988 Towfigh ..... 108/10
5,029,715 A * 7/1991 Strada ..... 211/55
5,031,781 A * 7/1991 Price et al. ..... 211/45
5,167,191 A * 12/1992 Muth ..... 108/108
5,394,995 A * 3/1995 Lusk et al. ..... 211/59.2
5,806,688 A * 9/1998 Adenau et al. ..... 211/47
6,123,208 A * 9/2000 Haenszel ..... 211/175
6,170,674 B1 * 1/2001 Caterinacci ..... 211/41.1
6,484,890 B1 * 11/2002 Miller ..... 211/45
8,312,998 B2 * 11/2012 Theisen ..... 211/45
2002/0023890 A1 * 2/2002 Jensen et al. ..... 211/168
2009/0188875 A1 * 7/2009 Wade et al. ..... 211/45
2010/0181267 A1 * 7/2010 Theisen ..... 211/45
2011/0297630 A1 * 12/2011 O'Day et al. ..... 211/59.2

* cited by examiner

*Primary Examiner* — Joshua Rodden
*Assistant Examiner* — Patrick Hawn
(74) *Attorney, Agent, or Firm* — Volpe and Koenig, P.C.

(57) ABSTRACT

A display system is provided having at least one C-channel having a pair of inwardly extending lips. A plurality of rails having complementary engagement structures are engaged in the C-channel with the lips engaged with the engagement structures. The rails have support structures for displaying flat goods. One type of rail includes a V-shaped support surface to support a corner of an article to be displayed. The C-channels can also be arranged in pairs with left hand and right hand rails being connected to the respective C-channels. The support surfaces on respective left hand and right hand rails are generally aligned and define a support space.

14 Claims, 39 Drawing Sheets

20
22
24
26
28
30
32
34
36
38

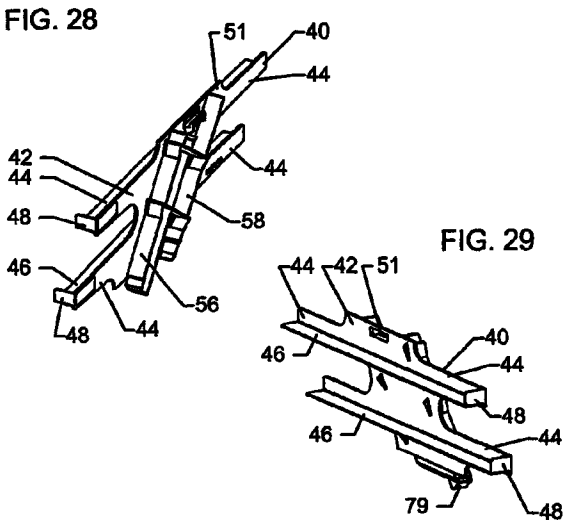
FIG. 28
FIG. 29
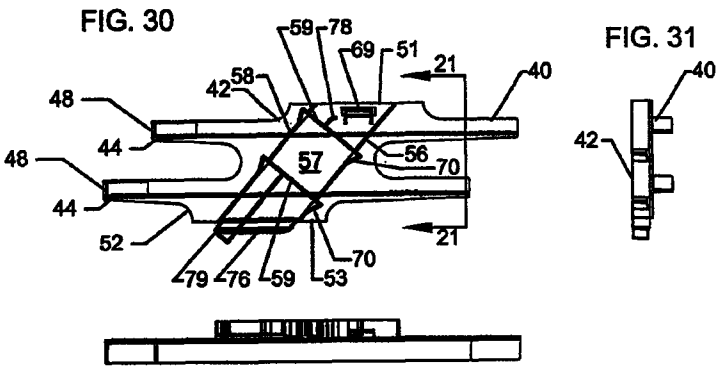
FIG. 30
FIG. 31
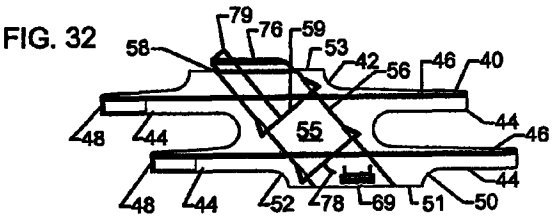
FIG. 32

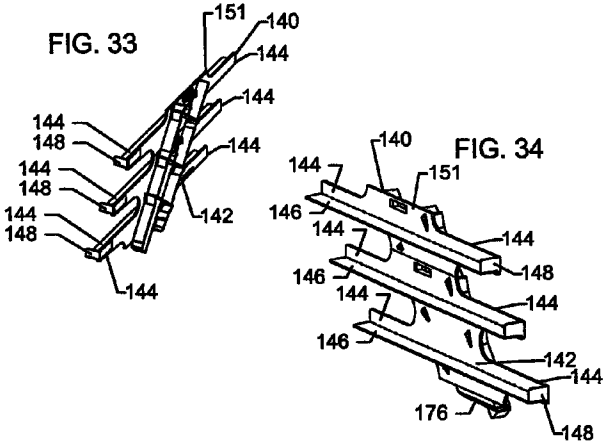
FIG. 33
FIG. 34
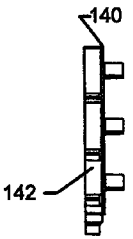
FIG. 36
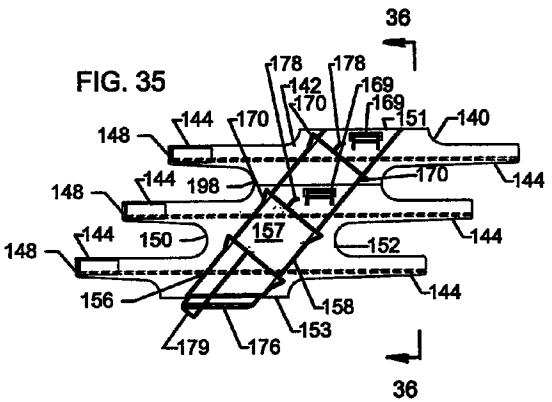
FIG. 35
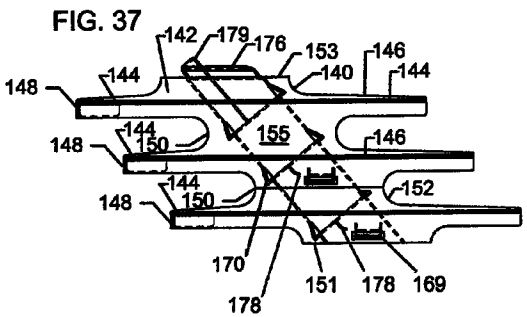
FIG. 37

210
222
222

210
220
224
281
280
290
2
260
220
224

294
210
231
284
234
222
234
290
281
240
240
260
280
240
234
220
294
224
222

210
240
224
220
222

210
220
224
240
222
290
2
280
260
220
222

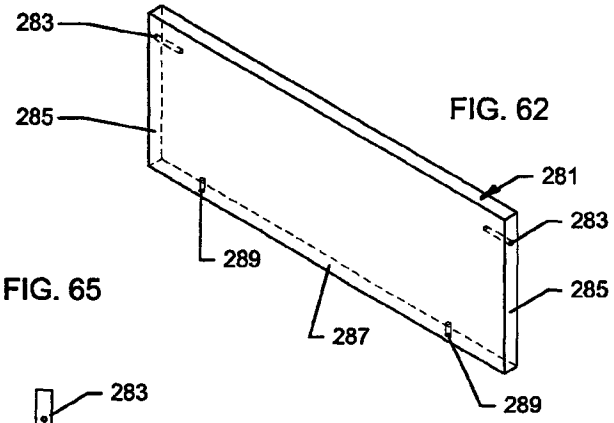
FIG. 62
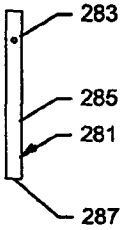
FIG. 65
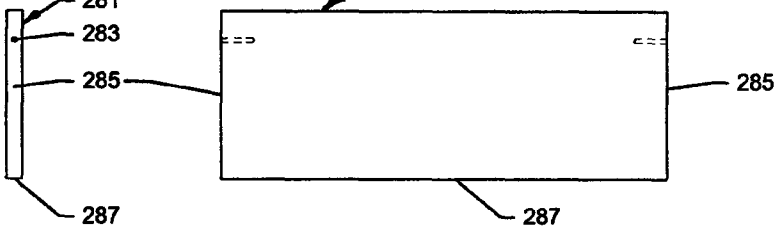
FIG. 64
FIG. 63
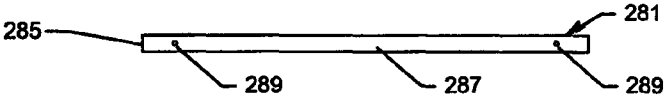
FIG. 66

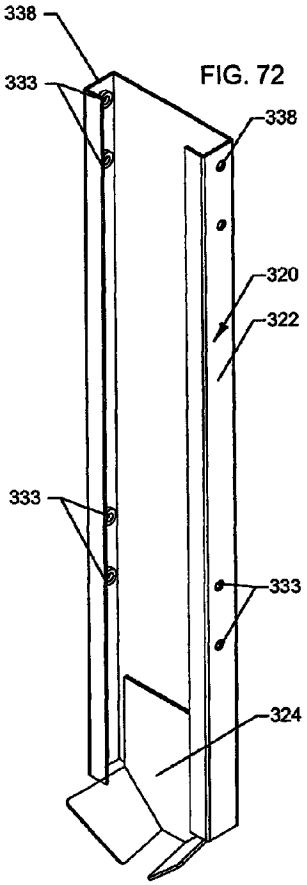
FIG. 72
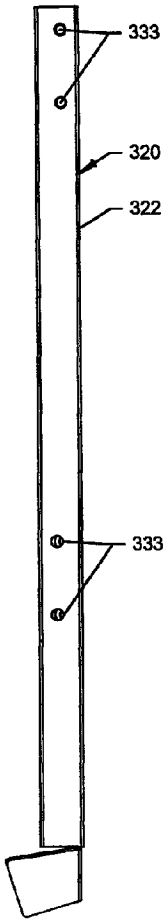
FIG. 71
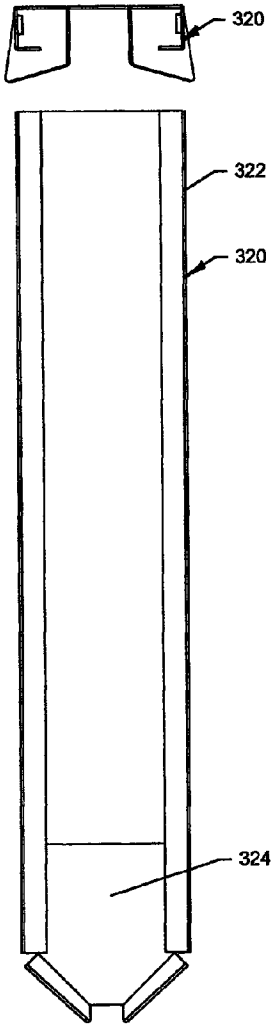
FIG. 69
FIG. 70

DISPLAY SYSTEM

CROSS-REFERENCE TO RELATED APPLICATIONS

This application claims the benefit of U.S. Provisional Application No. 61/251,537, filed Oct. 14, 2009, which is incorporated herein by reference as if fully set forth.

BACKGROUND

In settings where flat goods, such as flooring materials are sold, samples of the materials for sale are traditionally put on display for consumers to view. The samples are typically displayed on a display that may contain, for example, a particular type of flooring, or various floorings produced by a particular manufacturer. Some examples of materials displayed may include wood flooring, laminates, tile, and carpets.

Displays come in various styles to meet different needs of a particular setting or to accommodate the different types of materials that are displayed. Common varieties of displays include the "waterfall" display, "V" display and "winged" displays. In waterfall displays, samples are disposed in frames oriented at a common angle and stacked on top of each other in a spaced apart configuration. In one variation the stack may be oriented at an angle to provide a different aesthetic appeal. The "V" display has a similar stacking configuration but varies from the waterfall display in that the frames are "V" shaped and support the samples, which are typically square shaped, so that the edges are oriented approximately 45° with respect to the horizontal direction. A winged display includes a plurality of pages or "wings" that house the samples and are vertically pivotally affixed to the unit.

Many known display systems are limited in that they only permit display of a specific number of samples and samples of only specific sizes. Additionally, most displays are not flexible with respect to the amount of space between the samples being displayed. Most known display systems are also cumbersome to assemble, requiring excessive hardware and tools, for a labor-intensive on-site assembly. A need therefore exists for a display system that permits adjustability in the number and size of samples that can be displayed, and can be easily assembled in few steps and with few tools and hardware.

SUMMARY

A display system is provided having at least one C-channel having a pair of inwardly extending lips. A plurality of rails having complementary engagement structures are engaged in the C-channel with the lips engaged with the engagement structures. The rails have support structures for displaying flat goods.

In one type of rail, a V-shaped support surface is provided to support a corner of an article to be displayed. The C-channel can be mounted vertically to a base of could be angled, preferably at an angle of 60° to 90°.

In another arrangement, the C-channels are arranged in pairs with left hand and right hand rails being connected to the respective C-channels. The support surfaces on respective left hand and right hand rails are generally aligned and define a support space. The rails can each include a single pair of aligned arms with a support surface extending across the arms, or can include a plurality of pairs of the arms. The arms on a respective rail can be parallel or set at different angles relative to each other, with also the possibility of different spacing and reveal distances.

In another aspect, a rail is provided that can be installed in one of two different orientations on order to provide a different spacing between the support surfaces of adjacent rails. A spacer can also be installed between the rails to provide different spacing.

The features noted above and described in detail below can be implemented singly or in various combinations in order to provide numerous display options.

BRIEF DESCRIPTION OF THE DRAWINGS

The foregoing Summary as well as the following Detailed Description will be best understood when read in conjunction with the attached drawings. In the drawings:

FIG. 13 is a top plan view of the leg of FIG. 12;

FIG. 14 is a front elevation of the leg of FIG. 12;

FIG. 15 is a front perspective view of the leg of FIG. 12;

FIG. 16 is an enlarged detail of FIG. 15;

FIG. 17 is an exploded front perspective view of the leg of FIG. 12;

FIG. 28 is a front perspective view of a right rail of the display of FIG. 1;

FIG. 29 is a rear perspective view of the rail of FIG. 28;

FIG. 30 is a right side elevation of the rail of FIG. 28;

FIG. 31 is a section taken along line 31-31 of FIG. 28;

FIG. 32 is a left side elevation of the rail of FIG. 28, with the rail inverted;

FIG. 33 is a front perspective view of an alternative embodiment of the right rail;

FIG. 34 is a rear perspective view of the rail of FIG. 33;

FIG. 35 is a right side elevation of the rail of FIG. 33;

FIG. 36 is a section taken along line 36-6 of FIG. 35;

FIG. 37 is a left side elevation of the rail of FIG. 33, with the rail inverted;

FIG. 62 is a front perspective view of the filler board of the display of FIG. 50;

FIG. 63 is a left side elevation of the filler board of FIG. 63;

FIG. 64 is a front elevation of the filler board if FIG. 63;

FIG. 65 is a right side elevation of the filler board of FIG. 63;

FIG. 66 is a bottom plan view of the filler board if FIG. 63;

FIG. 69 is a top plan view of the leg of the display of FIG. 68;

FIG. 70 is a front elevation of the leg of FIG. 68;

FIG. 71 is a right side elevation of the leg of FIG. 68;

FIG. 72 is a front perspective view of the leg of FIG. 68;

FIGS. 91A and 91B.

DETAILED DESCRIPTION OF THE PREFERRED EMBODIMENTS

Figure 5:
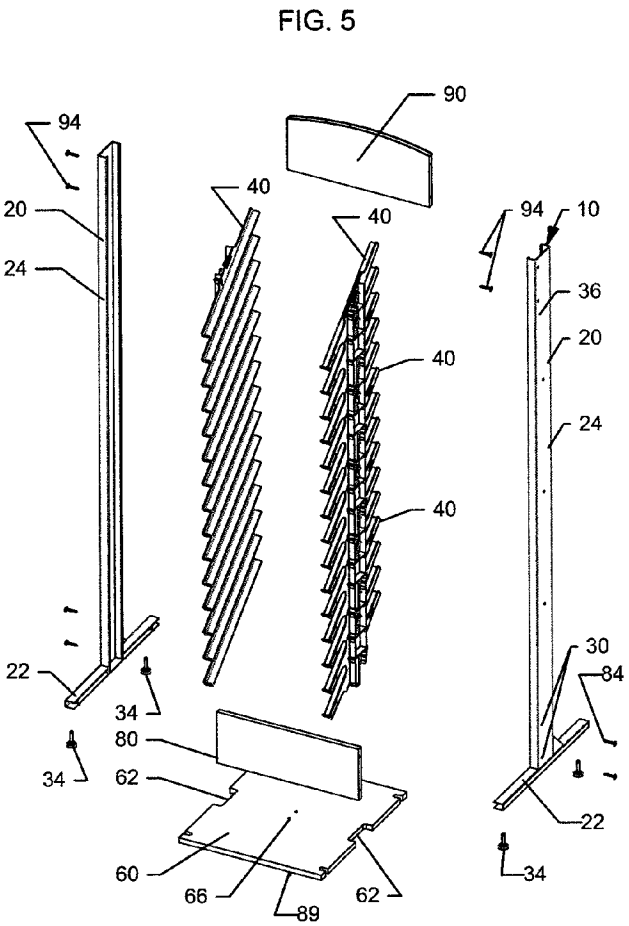
FIG. 5 is an exploded front perspective view of the display of FIG. 1.
Figure 3:
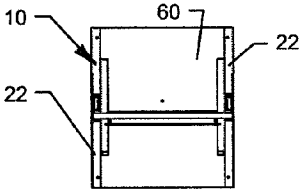
FIG. 3 is a top plan view of the display of FIG. 1.

Certain terminology is used in the following description for convenience only and is not considered limiting. Words such as "front," "back," "top," "bottom," "left," and "right" designate directions in the drawings to which reference is made. This terminology includes the words specifically noted above, derivatives thereof, and words of similar import. Additionally, the terms "a" and "one" are defined as including one or more of the referenced item unless specifically noted. The phrase "at least one of" followed by a list of two or more items, such as "A, B or C," means any individual one of A, B or C, as well as any combination thereof.

FIGS. 1-5 show a first embodiment of the display 10. As shown, the display 10 includes two legs 20, a plurality of rails 40 supported by the legs 20, a base 60 that supports the legs 20, a brace 80 extending vertically from the base 60 and affixed between bottom portions of the legs 20 below the rails 40, and a header 90 affixed between top portions of the legs 20 above the rails 40.

As shown in FIGS. 1-5 and 38-40, the base 60 is a generally planar member at the bottom of the display 10 that rests on a surface beneath the display 10, supporting the legs 20 and the brace 80. Notches 62, 68 are formed in opposite edges 64 of the base to facilitate affixing the legs 20 thereto and holes 66 are formed to facilitate affixing the brace 80 thereto, as explained further below.

Figures 6, 7, 8, 9, 10, 11:
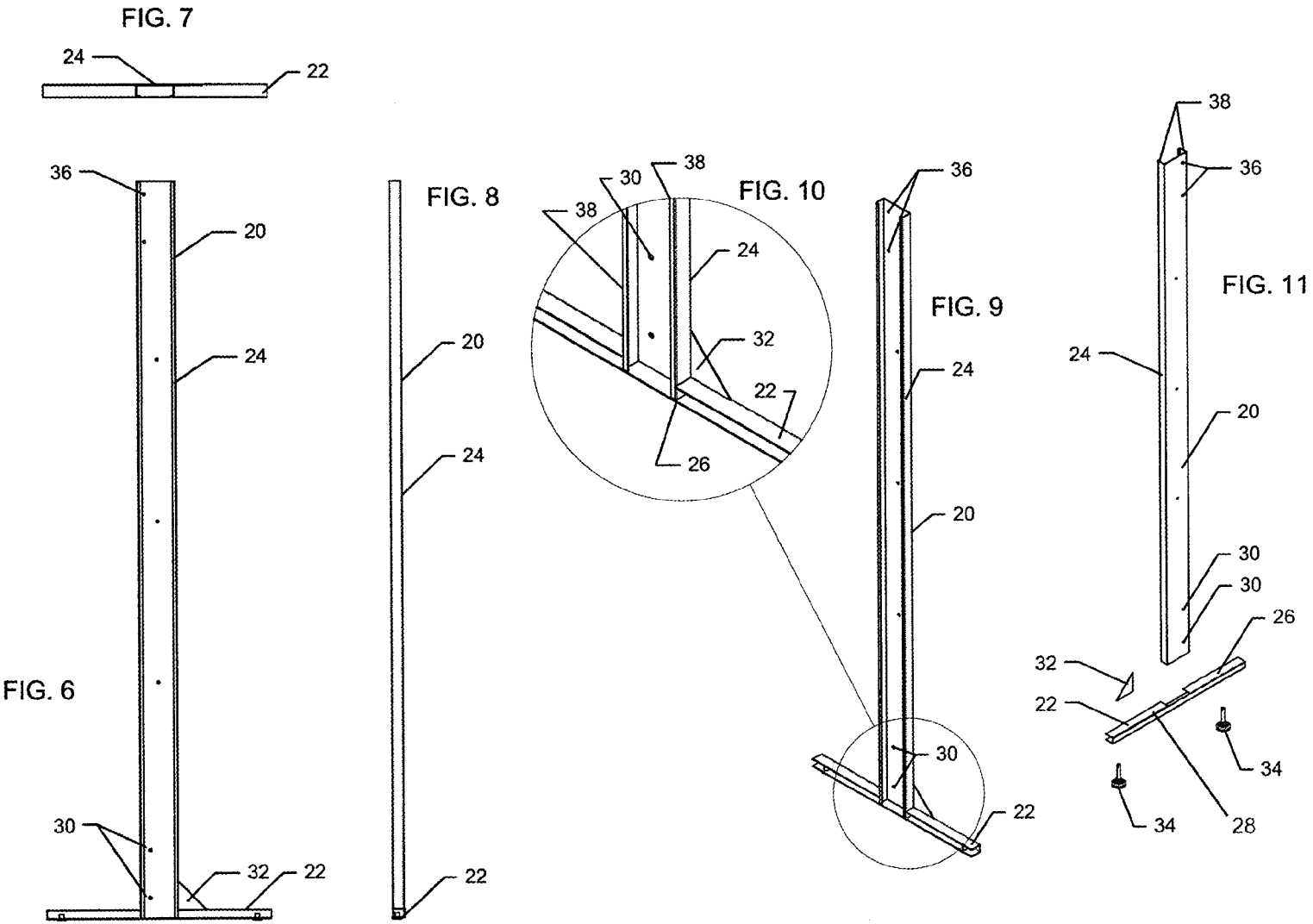
FIG. 6 is a right side elevation of the left leg of the display of FIG. 1.
FIG. 7 is a top plan view of the leg of FIG. 6.
FIG. 8 is a front elevation of the leg of FIG. 6.
FIG. 9 is a rear perspective view of the leg of FIG. 6.
FIG. 10 is an enlarged detail of FIG. 9.
FIG. 11 is an exploded front perspective view of the leg of FIG. 6.
Figure 12:
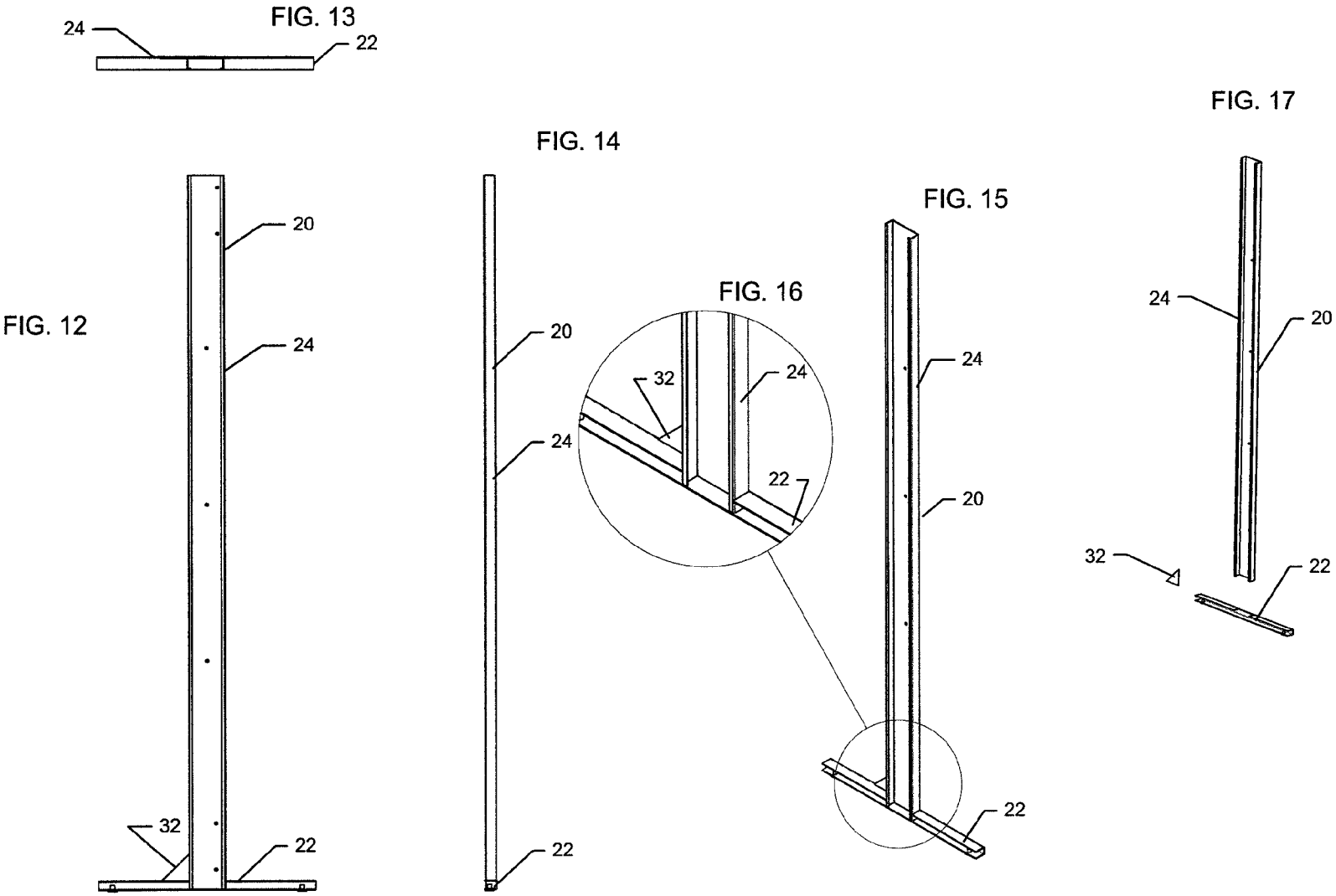
FIG. 12 is a left side elevation of the right leg of the display of FIG. 1.
Figure 18:
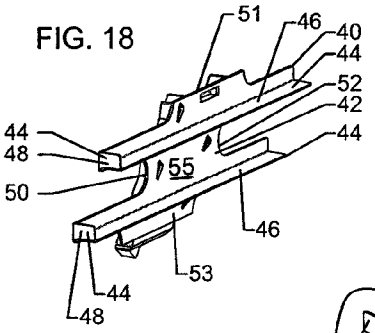
FIG. 18 is a front perspective view of a left rail of the display of FIG. 1.
Figure 19:
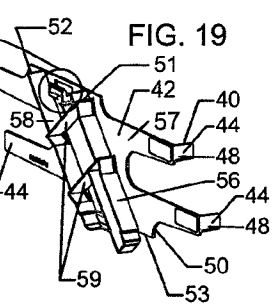
FIG. 19 is a rear perspective view of the rail of FIG. 18.
Figure 19A:
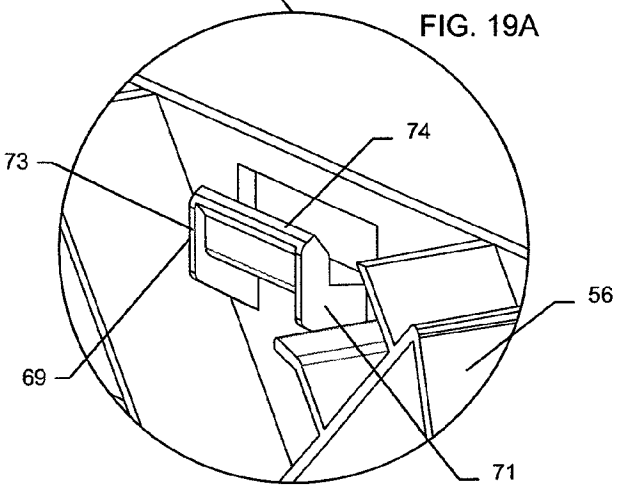
FIG. 19A is an enlarged detail of FIG. 19.
Figure 21:
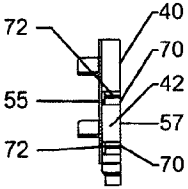
FIG. 21 is a section taken along line 21-21 of FIG. 20.

The legs 20 of the display are shown in detail in FIGS. 6-17. FIGS. 6-11 show the left leg 20 of the display 10 and FIGS. 12-17 show the right leg 20. The right and left legs 20 of the embodiment shown are mirror images of each other and only the left leg 20 will be described in detail. Referring to FIG. 6, the leg 20 includes a horizontally extending foot 22 and a vertically extending post 24. In the embodiment shown the foot 22 and post 24 are disposed at generally right angles with respect to each other. In an alternative embodiment, the post 24 could extend at a different angle with respect to the foot 22, which results in a different stacking arrangement of samples held by the display 10 for a different aesthetic appeal. The foot 22 supports the post 24 and is affixed to an edge 64 of the base 60 as show in FIG. 1. In the embodiment shown, the foot 22 is formed as a generally "U" shaped channel that receives the edge 64 of the base 60. The right and left feet 22 are affixed to opposite left and right edges 64 of the base to support the legs 20 at positions opposite each other at opposite edges of the base 60. In the embodiment shown, fasteners 34 pass through the notches 68 in the base 60 to secure the feet 22 thereto, as shown in FIG. 5.

Referring to FIGS. 10 and 11, an opening 26 is formed in an upper wall 28 of the foot 22 and receives the post 24, which is affixed therein, preferably by welding. The post 24 passes through a respective one of the notches 62 formed in the base 60. A bracket 32 may be affixed between the foot 22 and the post 24, for example by welding, to provide further support to the leg assembly 20. As best shown in FIGS. 9 and 10, the post 24 forms a "C" shaped channel to facilitate attachment of the rails 40 as described in greater detail below.

Figure 4:
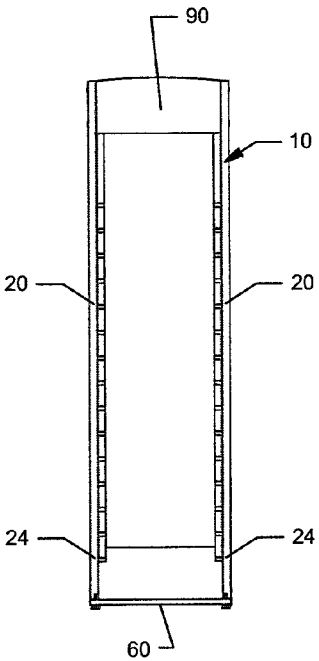
FIG. 4 is a front elevation of the display of FIG. 1.
Figure 1:
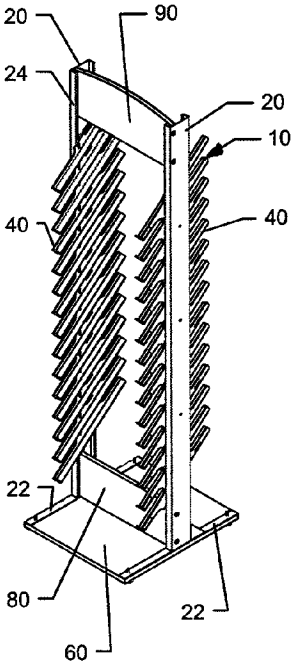
FIG. 1 is a front perspective view of a first embodiment of the display.

As shown in FIGS. 1-5 and 41-45, the brace 80 is a generally planar member having opposite edges 82 received by the "C" shaped channels of the posts 24. The brace 80 sits atop the base 90 between the legs 20 at bottom portions thereof, as shown in FIGS. 1, 4, and 5. Fasteners 84 such as screws may be provided for affixing the brace 80 to the legs 20 by passing through coaxial holes 30, 86 formed in the posts 24 and brace 80, respectively. Coaxial holes 66, 89 may also be formed in the base 60 and brace 80, respectively for receiving additional fasteners to affix the brace 80 thereto.

The header 90 is shown in FIGS. 1-5 and 46-49. As shown, the header 90 is a generally planar member having opposite edges 92 received by the "C" shaped channels of the posts 24. The header 90 is held between the legs 20 at top portions thereof, as shown in FIGS. 1, 4, and 5. Fasteners 94 such as screws may be provided for affixing the header 90 to the legs 20 by passing through coaxial holes 36, 96 formed in the legs 20 and header 90 respectively. The surface of the header 90 may include a design or logo, for example, to identify the product displayed on the display 10. The header 90 of FIGS. 46-49 has an arcuate top edge 291, but may take on other shapes as well.

The base 60, brace 80 and header 90 can be provided in various sizes, to permit the distance between legs 20 to vary so that samples 2 of different sizes can be housed by the display 10.

As shown in FIGS. 1-5 a plurality of rails 40 are affixed to the legs 20 between the brace 80 and the header 90. The rails 40 are shown in detail in FIGS. 18-37. FIGS. 18-27 show the left rail 40 and FIGS. 27-37 show the right rail 40. The left and right rails 40 of the embodiment shown are mirror images of each other and only the left rail 40 will be described in detail.

As shown in FIGS. 18-22, each of the rails 40 includes a body 42 having a generally planar configuration. The body 42 includes a front edge 50 that faces forward when the display 10 is assembled, a rear edge 52 that faces rearward when the display 10 is assembled, an inner face 55 that faces inward the with respect to the display 10 when assembled and an outer face 57 that faces outward with respect to the display 10 when assembled. As shown, the front and rear edges 50, 52 are angled with respect to the top and bottom edges 51, 53, such that the body 42 substantially defines a parallelogram shape. A plurality of arms 44 extend out from the body 42. Each arm 44 extends from the front or rear edge 50, 52 of the body 42 in a direction parallel to the top and bottom edges 51, 53 and is aligned with another arm 44 extending from the opposite one of the front or rear edge 50, 52 of the body 42. Longitudinal support walls 46 extend across the inner face 55 of the body 42 between aligned sets of arms 44. In the embodiment shown, two sets of aligned arms 44 and two longitudinal support walls 46 are provided, but fewer or more arms 44 and support walls 46 could be provided as well. The arms 44 and support walls 46 extend generally parallel to the top and bottom 51, 53 edges of the body 42, and aligned arms 44 preferably each extend an equal distance from the front and rear edges 50, 52. When the display 10 is assembled, a materials sample 2 can be supported on support walls 46 of left and right rails 40 disposed opposite each other.

When the display 10 is in an assembled configuration, the rails 40 are affixed to the posts 24 of the legs 20, such that the front and rear edges 50, 52 of the body 42 are generally parallel to the posts 24, and the arms 44 and support walls 46 are angled with respect to the posts 24. The arms 44 extending from the front edge 50 are angled in a forward, downward direction with respect to the post 24, and the arms 44 extending from the rear edge 52 are angled in a rearward, upward direction with respect to the post 24. This permits samples 2 resting on support walls 46 to be displayed at angles, so that multiple samples can be stacked and remain visible. Stop walls 48 are provided at the ends of arms 44. The stop walls 48 each extend between the edges of a respective arm 44 and the support wall 46, and serve to block a sample 2 supported by the rail 40 from sliding off of the support wall 46.

Guides 54 are provided on the outer faces 57 of the rails 40 for slidably affixing the rails 40 to the legs 20. The guides 54 include front and rear guide walls 56, 58. Both guide walls 56, 58 extend generally parallel to the front and rear edges 50, 52 of the body 42, with the front guide wall 56 being located adjacent the front edge 50 and the rear guide wall 58 being located adjacent the rear edge 52. Transverse walls 59 may extend between front and rear guide walls 56, 58 to provide a stable connection therebetween. Two transverse walls 59 are shown in FIGS. 18-22, but fewer or more may be provided as well.

As shown in FIG. 5, the rails 40 are configured to slidably engage the "C" shaped channel of the leg 20. As best shown in FIGS. 10 and 11, the channels define a pair of inwardly extending lips 38. Protruding portions 70 angle outward from the front and rear guide walls 56, 58 and join with the transverse walls 59. Gaps 72 are defined between the outer face 57 of the body 42 and the protruding portions 70 of the guide walls 56, 58. To affix the rails 40 to the legs 20, the guide walls 56, 58 are inserted into the "C" shaped channels at the upper ends of the posts 24 such that the gaps 72 receive the lips 38.

Figure 2:
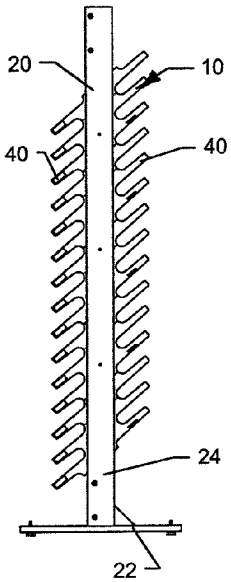
FIG. 2 is a right side elevation of the display of FIG. 1.
Figure 20:
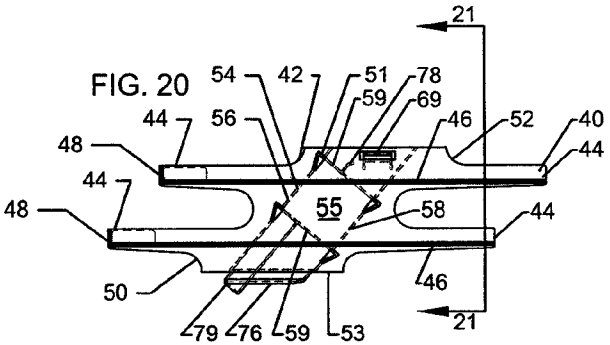
FIG. 20 is a right side elevation of the rail of FIG. 18.
Figure 22:
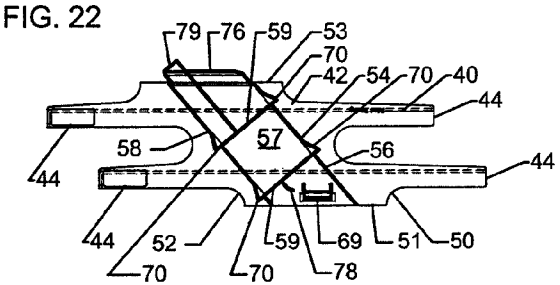
FIG. 22 is a left side elevation of the rail of FIG. 18, with the rail inverted.
Figure 23:
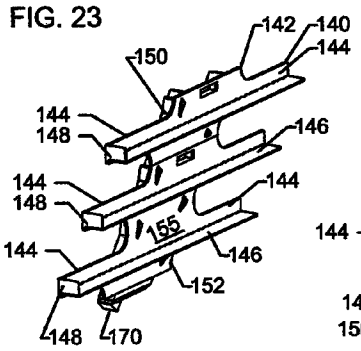
FIG. 23 is a front perspective view of an alternative embodiment of the left rail.
Figure 24:
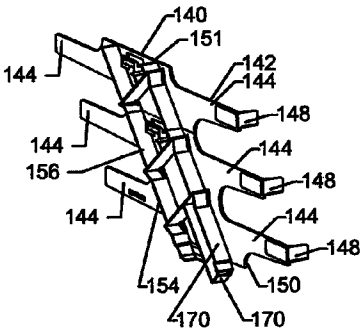
FIG. 24 is a rear perspective view of the rail of FIG. 23.
Figure 26:
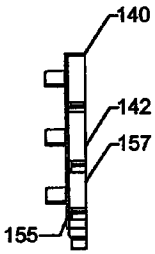
FIG. 26 is a section taken along line 26-26 of FIG. 25.
Figure 25:
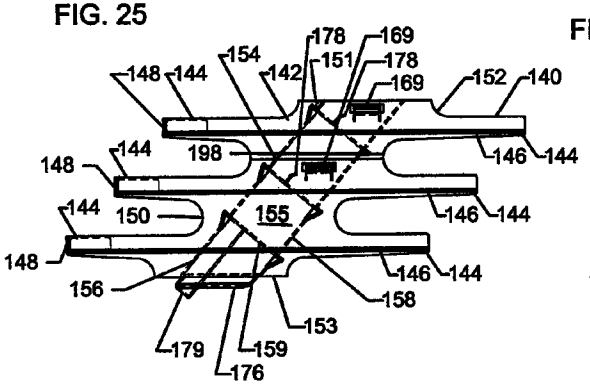
FIG. 25 is a right side elevation of the rail of FIG. 23.
Figure 27:
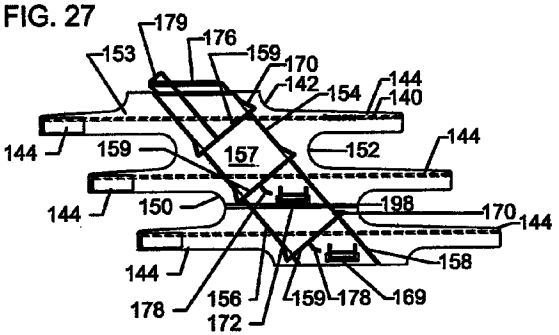
FIG. 27 is a left side elevation of the rail of FIG. 23, with the rail inverted.
Figure 38:
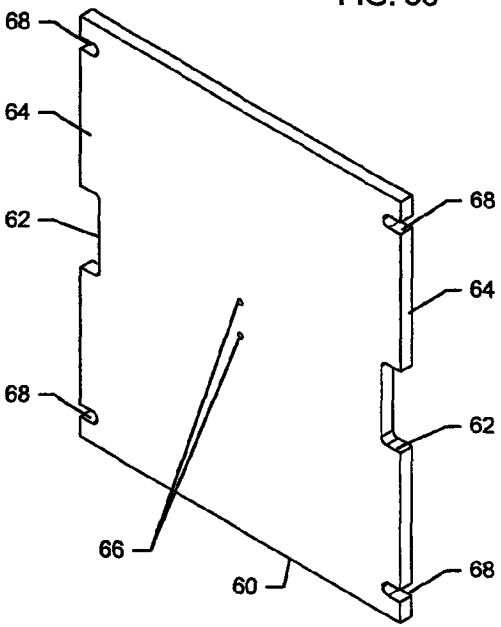
FIG. 38 is a front perspective view of the base of the display of FIG. 1.
Figure 39:
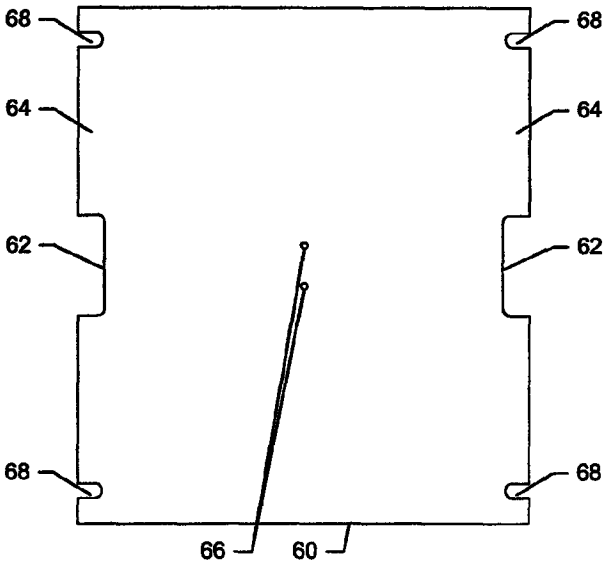
FIG. 39 is a top plan view of the base of FIG. 38.
Figure 40:
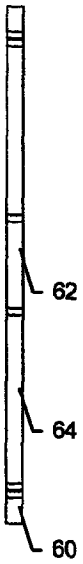
FIG. 40 is a front elevation of the base of FIG. 38.
Figure 41:
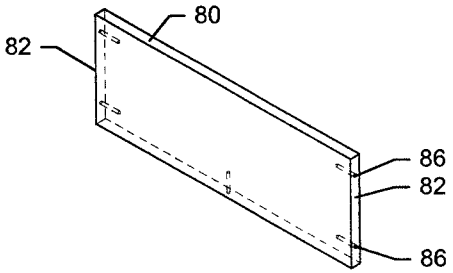
FIG. 41 is a front perspective view of the brace of the display of FIG. 1.
Figure 45:
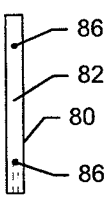
FIG. 45 is a right side elevation of the brace of FIG. 41.
Figure 42:
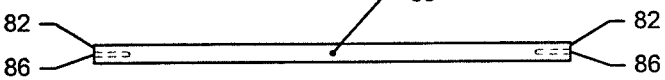
FIG. 42 is a top plan view of the brace of FIG. 41.
Figure 44:
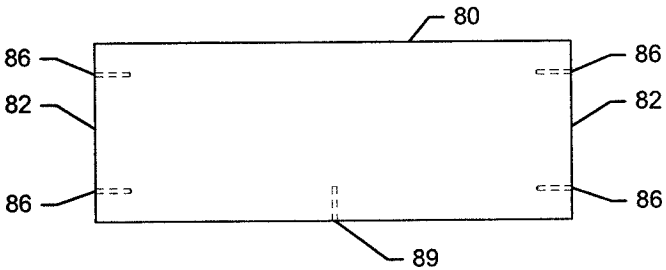
FIG. 44 is a front elevation of the brace of FIG. 41.
Figure 43:
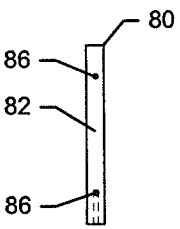
FIG. 43 is a left side elevation of the brace of FIG. 41.
Figure 46:
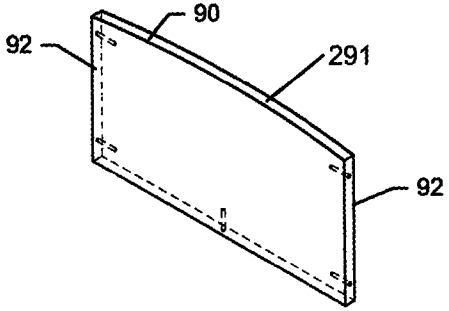
FIG. 46 is a front perspective view of the header of the display of FIG. 1.
Figure 49:
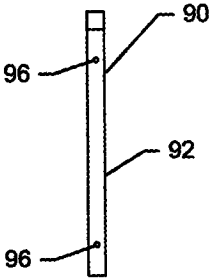
FIG. 49 is a right side elevation of the header of FIG. 46.
Figure 47:
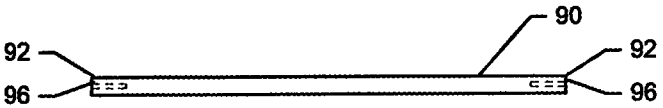
FIG. 47 is a top plan view of the header of FIG. 46.
Figure 48:
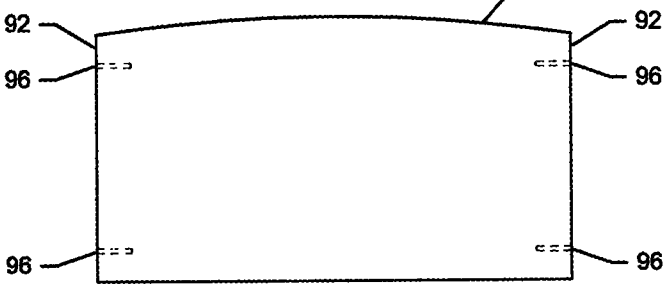
FIG. 48 is a front elevation of the header of FIG. 46.
Figures 50, 51, 52, 53, 54:
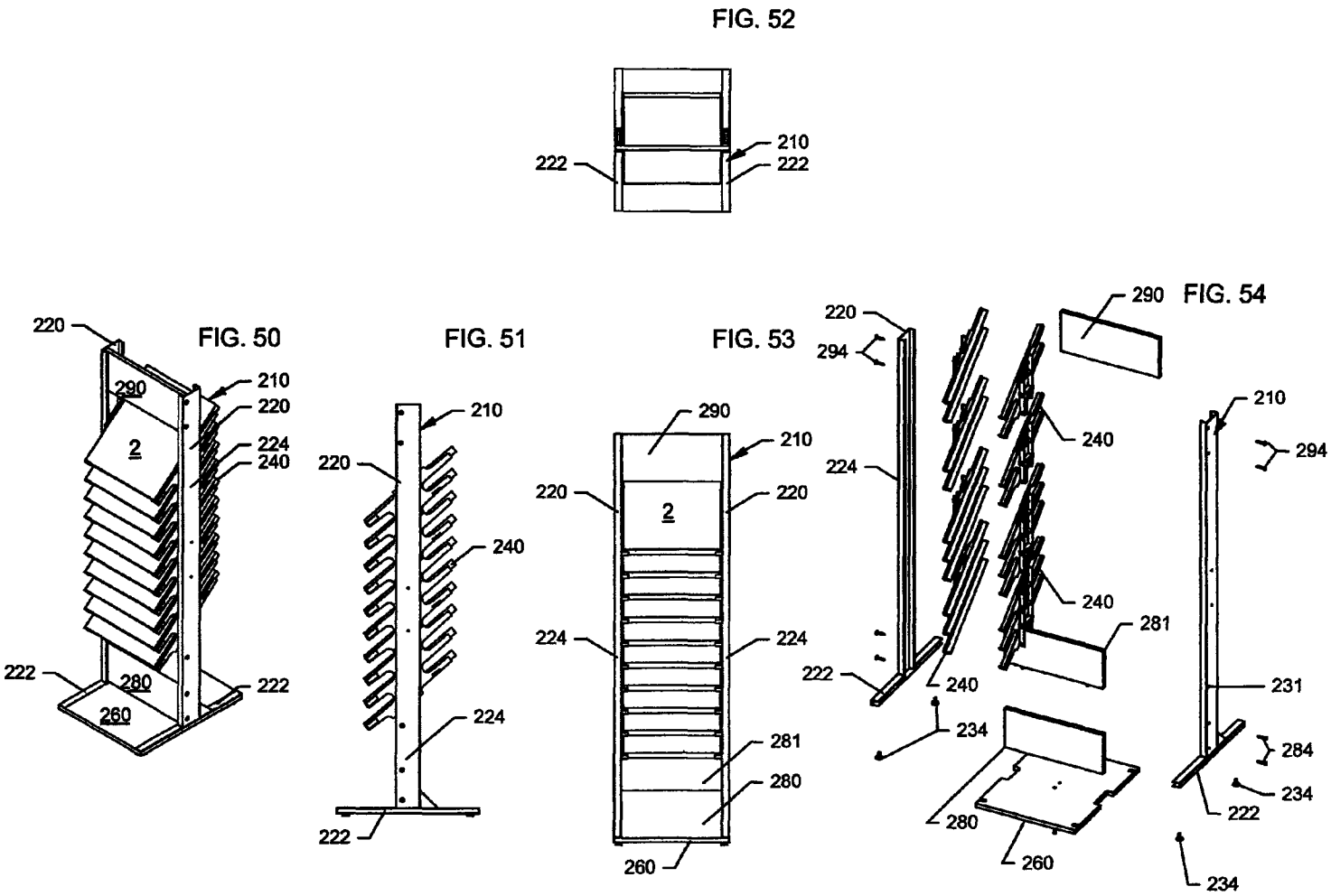
FIG. 50 is a front perspective view of a second embodiment of the display.
FIG. 51 is a right side elevation of the display of FIG. 50.
FIG. 52 is a top plan view of the display of FIG. 50.
FIG. 53 is a front elevation of the display of FIG. 50.
FIG. 54 is an exploded front perspective view of the display of FIG. 50.

As shown in FIGS. 1, 2, and 5, the rails 40 stack on top of each other when they engage the leg 20, and the number of rails 40 used can vary based on the number of samples 2 to be displayed. The rails 40 are also provided with a connection for locking with an adjacent rail 40 stacked above or below. In the embodiment shown a clasp 69 is provided near the upper edge 51 of the rail 40. The clasp 69 is generally "L" shaped, with a horizontal wall 71 extending out from the outer face 57 of the body 42 and a vertical wall 73 extending upward from an edge of the horizontal wall 71. A flange 74 extends inwardly from an end of the vertical wall towards the outer face 57. When the rails 40 are stacked on top of each other the flange 74 engages a bottom wall 76 extending between the front and rear guide walls 56, 58 and generally parallel to the bottom edge 53 of the body 42. As shown in FIGS. 20 and 22, the front and rear guide walls 56, 58 extend slightly below the bottom edge 53 of the body 42, and the bottom wall 76 connects them at their lower endpoints, such that the bottom wall 76 is situated slightly below the bottom edge 53 of the body. When a rail 40 is slid into the "C" shaped channel of the post 24 on top of another rail, the bottom wall 76 slides into the clasp 69 and snappingly engages the flange 74.

Tabs 78 may also be provided, extending from transverse walls 59 towards the top edge 51 of the body 42. A projecting portion 79 extends from the bottom wall 76 and is received by a space defined between the tab 78 and front guide wall 56 when rails 40 are stacked to further secure the connection therebetween.

An alternative embodiment of a rail 140 for use with the display unit is shown in FIGS. 23-27 and 33-37. Elements equivalent to those described above are designated using the same reference numbers, increased by 100. FIGS. 23-27 show a left rail 140 and FIGS. 33-37 show a right rail 140. The left and right rails 140 of the embodiment shown are mirror images of each other and only the left rail 140 will be described in detail. As shown, the rail 140 is substantially identical to that described above and shown in FIGS. 18-22 and 28-32, but includes three sets of aligned arms 144 instead of two. The rail 140 includes a body 142, arms 144 extending from the body 142, a support wall 146 and stop wall 148, front and rear guide walls 156, 158, transverse wall 159, as well as clasp 169 and tab 178. Each of these elements is configured in an analogous manner to those described above with respect to the rail 40. In the embodiment shown, the rail 140 includes two tabs 178 and two clasps 169. The clasp 169 and tab 178 located closest to the top edge 151 of the body 142 function the same as those described above. The lower clasp 169 and tap 178 do not function in the embodiment in which three sets of arms 144 are provided. These elements are included in this embodiment to permit the rail 140 having three sets of arms 144 and the rail 40 having two sets of arms 40 described above to be molded using the same tool, with a plug (not shown) being inserted in the tool cavity to produce the rail 40. This leaves a parting line 198 on the rail 140. This arrangement allows production of two different rails for maximum flexibility with one tool, although separate tools could be used. The spacing between the arms 44, 144 can be varied to provide a desired reveal, as can the angle of the arms 44, 144. Additionally, while a "C" channel is preferred, other shapes or separate vertical parts could be used, as long as the two spaced apart lips 38 are provided on each side for the left and right rails 40, 140 to be installed.

A second embodiment of the display 210 is shown in FIGS. 50-58. In this embodiment the display 210 is configured similarly to the display 10 described above, including two legs 220, a plurality of rails 240 supported by the legs 220, a base 260 that supports the legs 220, a brace 280 extending vertically from the base 260 and affixed between bottom portions of the legs 220 below the rails 240, and a header 290 affixed between top portions of the legs 220 above the rails 240. Each of these elements is configured similarly to those described above with respect to the first embodiment of the display 10 unless otherwise noted below. Elements equivalent to those described above are designated using the same reference numbers increased by 200.

The display 210 of FIGS. 50-57 includes a header 290 similar to the header 90 described above, but having a flat top edge, as shown in detail in FIGS. 58-61. Either of the headers 90, 290 can be used with either embodiment of the display 210.

Figure 55:
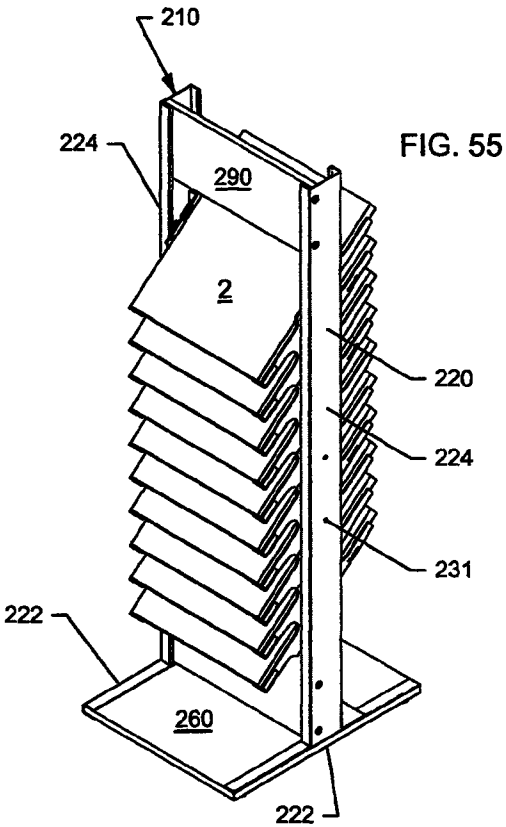
FIG. 55 is a front perspective view of the display of FIG. 50, with additional rails inserted to accept additional display materials.
Figure 56:
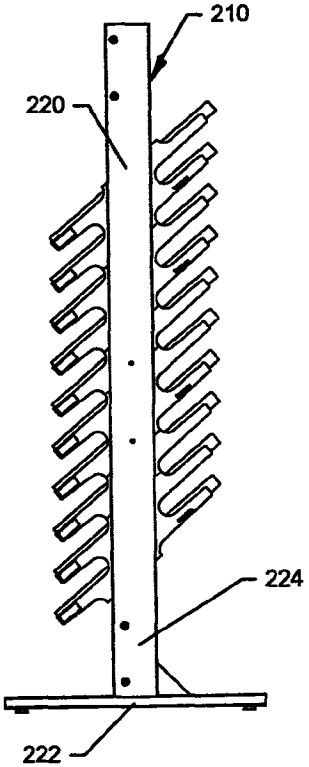
FIG. 56 is a right side elevation of the display of FIG. 55.
Figure 57:
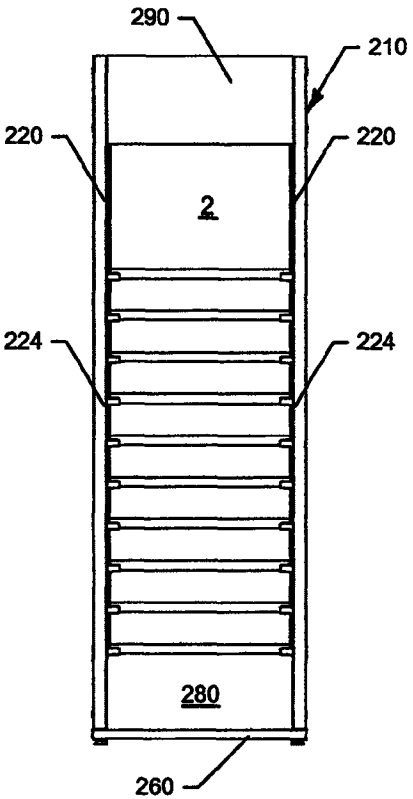
FIG. 57 is a front elevation of the display of FIG. 55.
Figure 58:
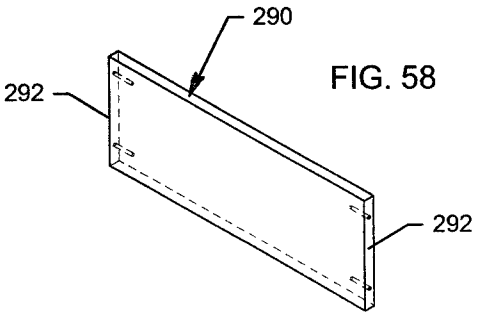
FIG. 58 is a front perspective view of the header of the display of FIG. 50.
Figure 61:
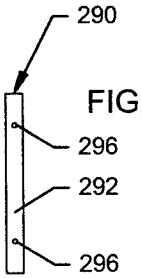
FIG. 61 is a right side elevation of the header of FIG. 58.
Figure 59:
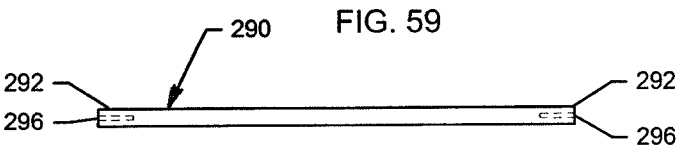
FIG. 59 is a top plan view of the header of FIG. 58.
Figure 60:
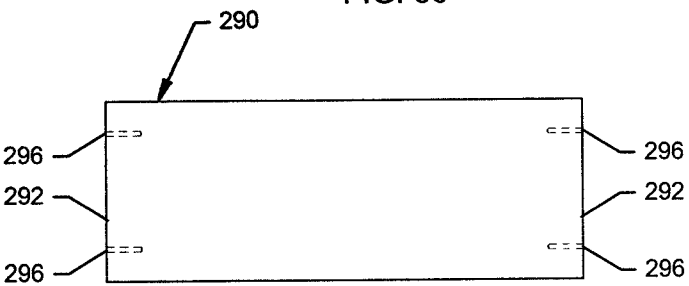
FIG. 60 is a front elevation of the header of FIG. 58.

The display of FIGS. 50-57 further includes a filler board 281 positioned above the brace 280 between the legs 220. The filler board 281 includes opposite edges 283 received by the "C" shaped channels of the posts 224. The filler board 281 can be removed from the display to allow additional rails 240 to be affixed to the posts 224 for display of additional materials samples 2, as shown in FIGS. 55-57. Where fewer samples 2 are to be displayed, additional filler boards 281 can be added to occupy additional space along the length of the legs 220.

The filler board 281 includes holes 283 at opposite edges 285 thereof that receive fasteners 235 that pass through holes 231 defined in the posts 224. Additional holes 231 in the posts 224 to those shown can be provided to facilitate attachment of additional filler boards 281. Holes 289 are also provided in a bottom edge 287 of the filler board 281 for receiving fasteners to attach the filler board 281 to the base 280. Holes may also be provided in the top edge to receive additional fasteners where additional filler boards 281 are used to decrease the number of samples 2 displayed.

Figure 68:
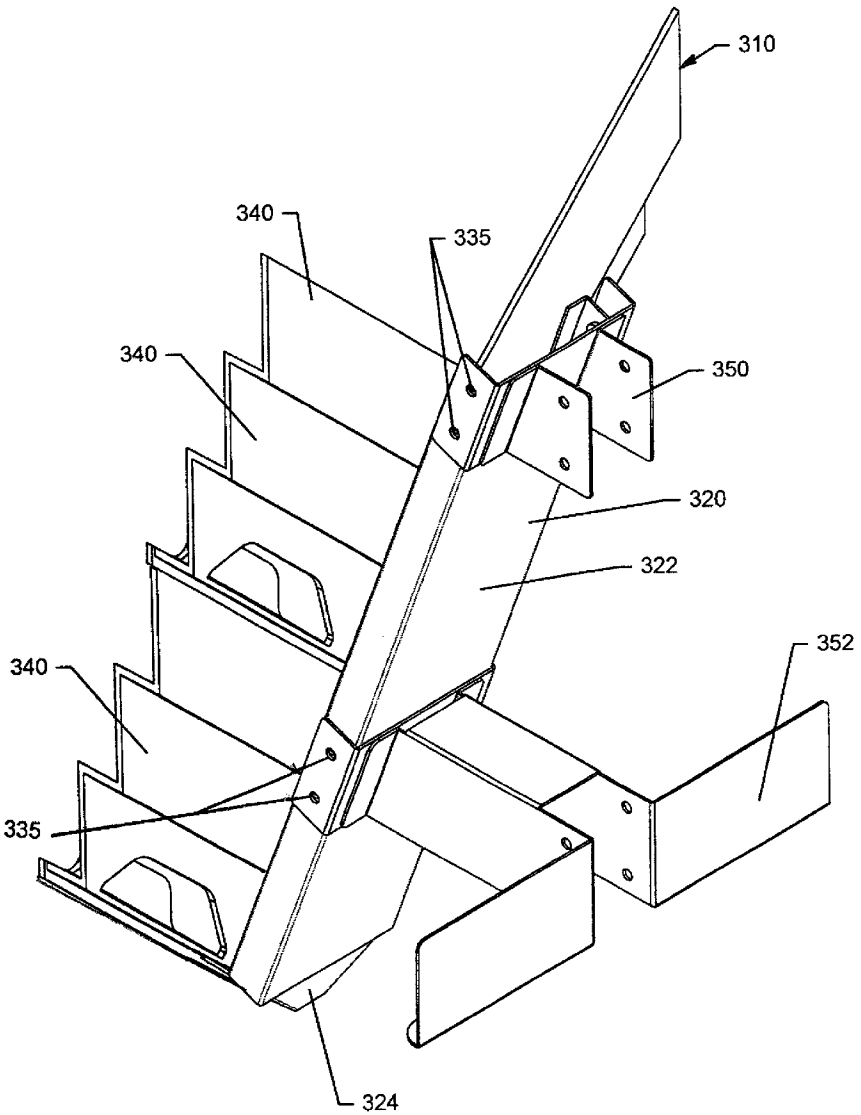
FIG. 68 is a rear perspective view of a third embodiment of the display.

A third embodiment of the display 310 is shown in FIG. 68. As shown, the display 310 includes a single leg 320 with a plurality of supports 340 disposed thereon for supporting a plurality of materials samples. Upper and lower mounting brackets 350, 352 are provided for fixing the display to an outside structure.

The leg 320 is shown in detail in FIGS. 69-72. As shown, the leg 320 includes a post 322 and a foot 324. The post 322 defines a generally "C" shaped channel and receives the foot 324 at a bottom portion thereof. The foot 322 and post 324 are preferably welded together but may be attached by any means known in the art.

Figure 75:
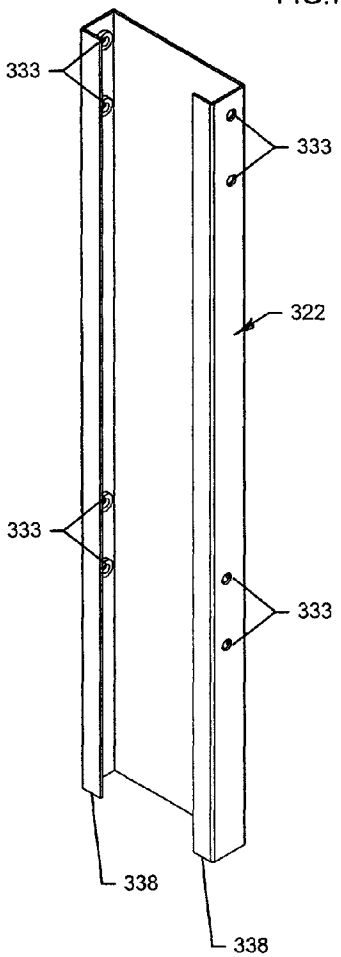
FIG. 75 is a front perspective view of the post of FIG. 73.
Figure 74:
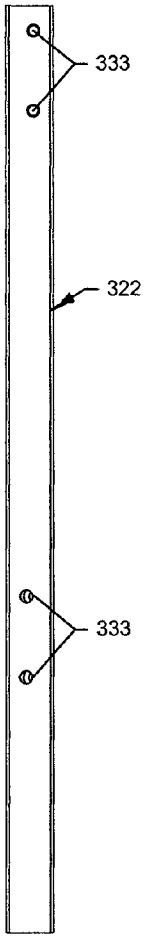
FIG. 74 is a right side elevation of the post of FIG. 73.
Figure 73:
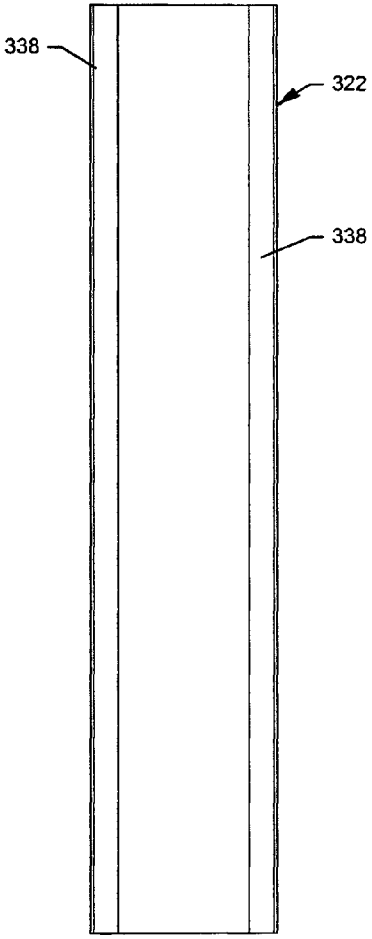
FIG. 73 is a front elevation of the post of the leg of FIG. 68.
Figure 78:
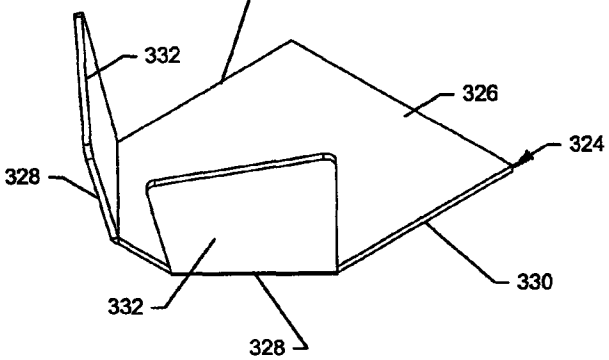
FIG. 78 is a front perspective view of the foot of FIG. 76.
Figure 79:
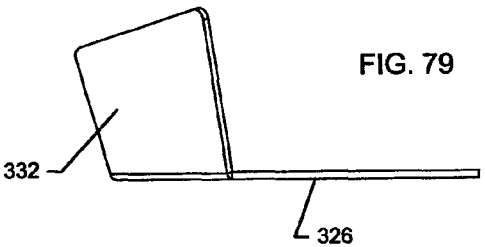
FIG. 79 is a right side elevation of the foot of FIG. 76.
Figure 76:
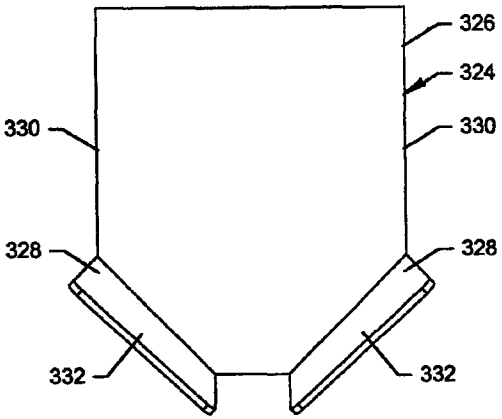
FIG. 76 is a front elevation of the foot of the leg of FIG. 68.
Figure 77:
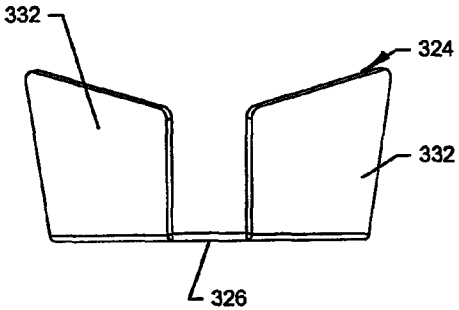
FIG. 77 is a bottom plan view of the foot of FIG. 76.
Figure 83:
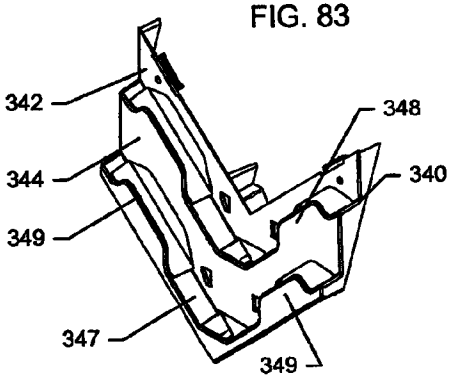
FIG. 83 is a front perspective of the support of FIG. 80.

The post 322 is shown in detail in FIGS. 73-75. As shown, the "C" shaped channel defines a pair of inwardly extending lips 338. Holes 333 are provided for receiving fasteners 335 (FIG. 68) for attachment of the mounting brackets 350, 352.

The foot 324 is shown in detail in FIGS. 76-79. The foot 324 includes a back wall 326 that is received by the channel of the post 322. Bottom edges 328 of the back wall 326 extend at angles of approximately 45° with respect to side edges 330 of the back wall 326, with supporting walls 332 extending perpendicularly therefrom.

Figure 82:
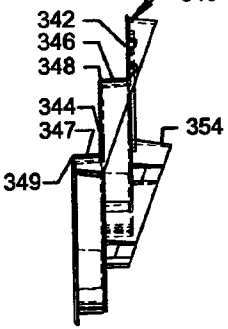
FIG. 82 is a right side elevation of the support of FIG. 80.

As shown in FIG. 68, the support 340 rests on the supporting walls 332 foot 324 when the display 310 is in the assembled configuration. The supports 310 are shown in detail in FIGS. 80-83, 84A and 84B. As shown, the supports 340 each include an upper wall and a lower wall 342, 344. Each wall is generally "V" shaped, with a 45° apex to support square samples with edges oriented at 45° with respect to the horizontal direction. However, these angles can vary to permit housing of samples having different shapes. As best shown in FIG. 82, the upper wall 342 is disposed upwards of and slightly rearwards of the lower wall 344, with an upper supporting wall 346 connecting the two. A lower supporting wall 347 extends forward from a bottom edge of the lower wall 344. Samples held by the display rest with their edges supported by the supporting walls 346, 347, and rear surfaces thereof resting against the upper and lower walls 342, 344. In the embodiment shown, the support 340 is configured to support two samples, but the number of walls 342, 344 and supporting walls 346, 347 could be increased or decreased to permit fewer or more samples to be displayed. Retaining surfaces 348, 349 extend upward from front edges of the supporting walls 346, 347 in front of the upper and lower walls 342, 344. The retaining surfaces 348, 349 extend in front of bottom edges of the samples held in the display 310 to retain the samples within the supports 340.

Figure 84A:
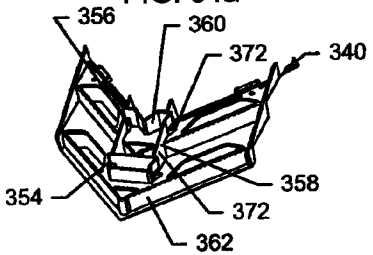
FIG. 84A is a rear perspective view of the support of FIG. 80.
Figure 84B:
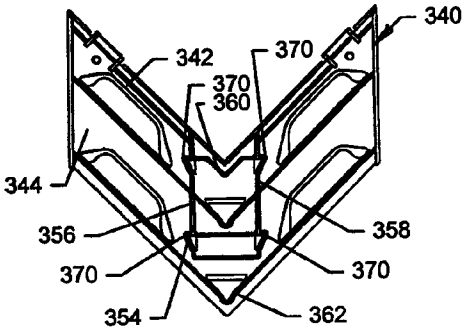
FIG. 84B is a rear view of the support of FIG. 80.
Figure 80:
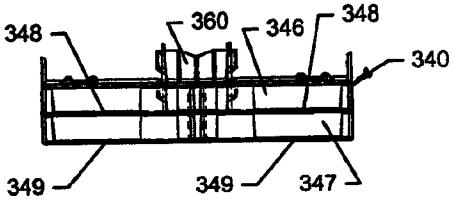
FIG. 80 is a top plan view of a sample support of the display of FIG. 68.
Figure 81:
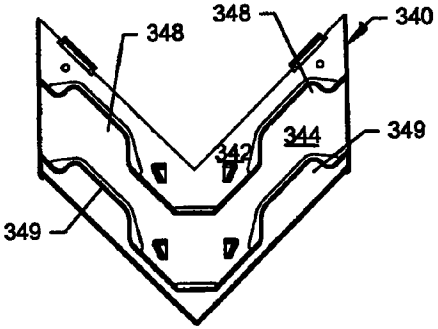
FIG. 81 is a front elevation of the support of FIG. 80.

As best shown in FIGS. 80, 84A, and 84B, the supports 340 include guides 354 for slidably attaching the supports 340 to the leg 320. The guides 354 include guide walls 356, 358, extending down the length of the support 340. The guide walls 356, 358 have protruding portions 370 that angle outward. Gaps 372 are defined between the upper and lower walls 342, 344 and protruding portions of the guide walls 356, 358. An upper "V" shaped wall 360 connects the guide walls 356, 358 at an upper portion of the guide 354, and a lower "V" shaped wall 362 connects the guide walls at a lower portion of the guide 354. To affix the support 340 to the posts 322 of legs 320, the guides 354 are inserted in to the "C" shaped channels at the upper ends of posts 324 such that the gaps 372 receive the lips 338. The support 340 is slid downward until the lower "V" shaped wall 362 rests on the supporting walls 332 of the foot 324. A second support 340 can then be attached to the post 322 in the same manner, and slid down unit its lower "V" shaped supporting wall 362 rests on the upper "V" shaped supporting wall 360 of the first support 340. Additional supports can be affixed to the leg 320 and stacked in the same manner to display any number of samples. The angle of the leg 320, as well as the spacing between the supporting walls 346, 347 can be varied to achieve different looks. Additionally, the number of supporting walls 346, 347 can be varied, depending on the particular application.

Figure 85A:
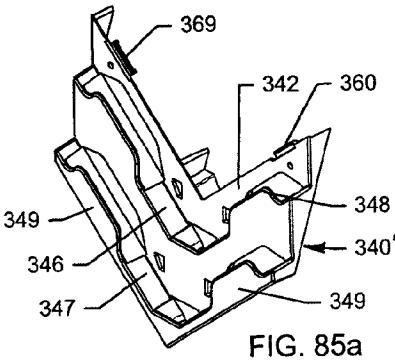
FIGS. 85A-85C are views of an alternate embodiment of the sample support for the display of FIG. 68.
Figure 85B:
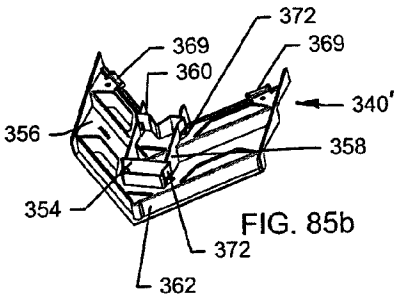
Figure 85C:
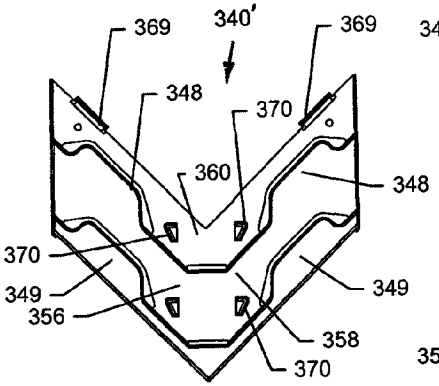

FIGS. 85A-85C show an alternate embodiment of the support 340'. The support 340' is structurally similar to the support 340 and the elements that are the same have been labeled with the same element numbers. Minor variations have been made in some of the walls to allow for easier molding of the support 340' from polymeric material. Clasps 369, similar to the clasps 69 described above, have been added at the upper edge to engage a next adjacent support 340'.

Figure 86A:
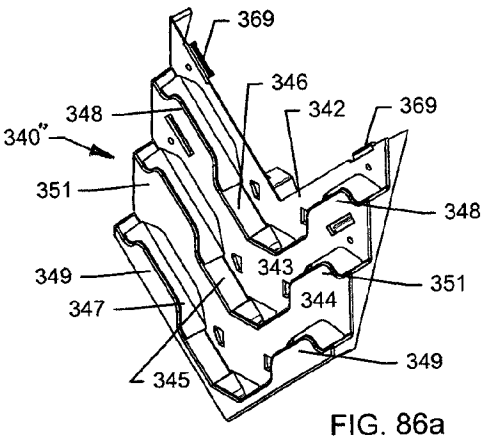
FIGS. 86A-86C are views of another alternate embodiment of the sample support for the display of FIG. 68 that can support three display items.
Figure 86C:
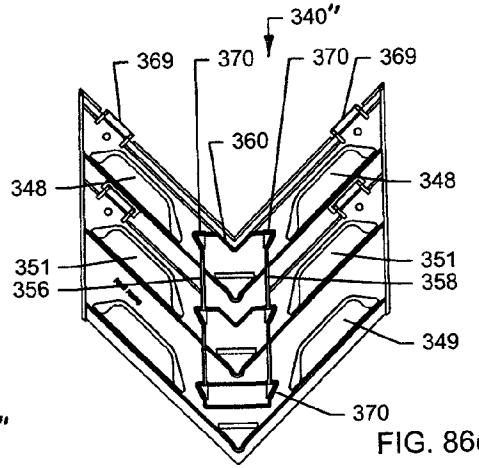
Figure 86B:
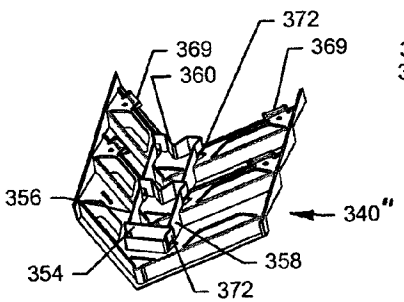

FIGS. 86A-86C show another embodiment of the support 340". The support 340" has generally the same construction as the support 340', except that it includes an intermediate wall 343, a third supporting wall 345 with retaining walls 351 in addition to the clasps 369. It also includes a third pair of protruding portions 370 on the back that extend from the guide walls 356, 358, forming another pair of gaps 372 for engaging the "C" shaped channels at the upper ends of posts 324 such that the gaps 372 receive the lips 338.

Figure 87A:
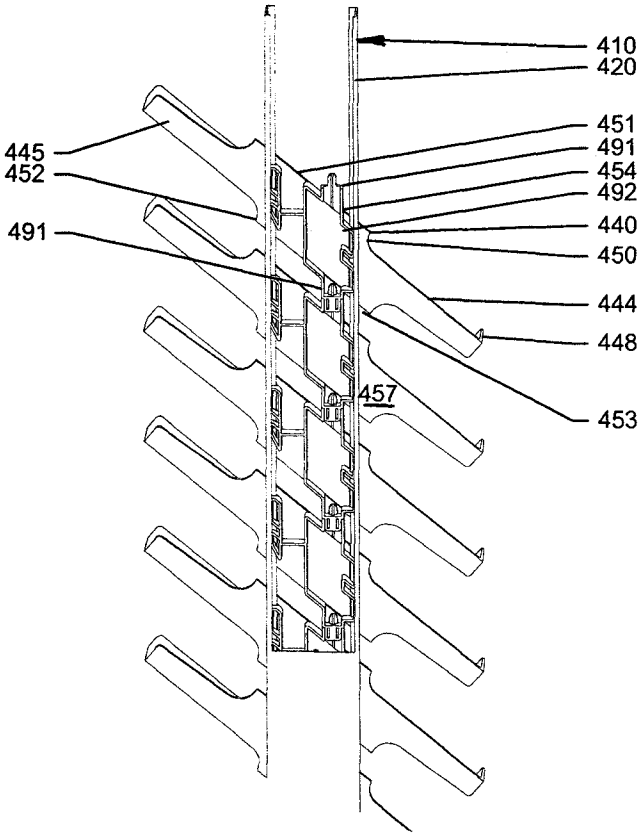
FIG. 87A is a partially cut away perspective view of a leg and rail assembly of a fourth embodiment of the display.
Figure 87B:
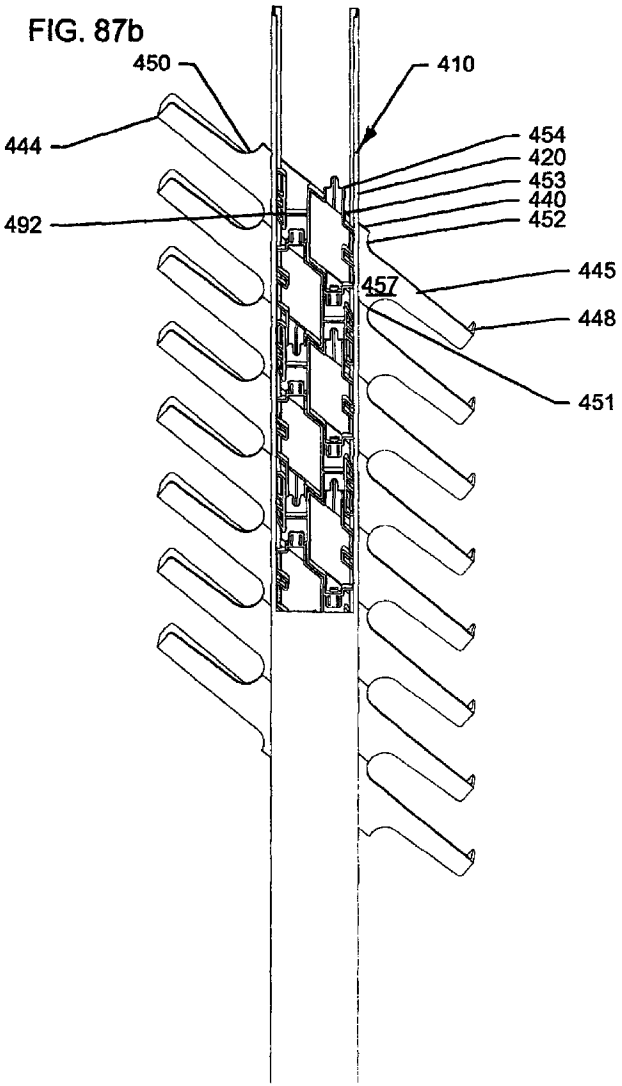
FIG. 87B is a partially cut away perspective view of the leg and rail assembly of FIG. 87A, with the rails inverted to reduce the space therebetween.
Figure 90B:
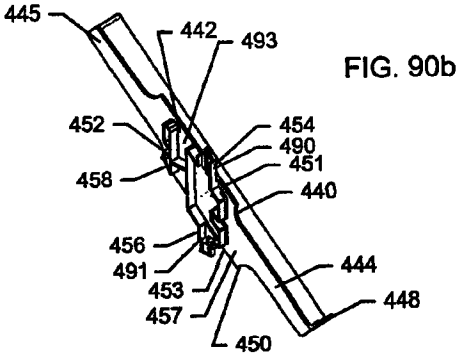
FIG. 90B is a rear perspective view of the rail of FIG. 88.
Figure 90A:
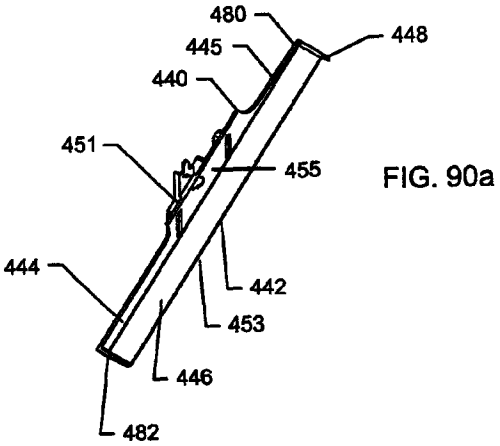
FIG. 90A is a front perspective view of the rail of FIG. 88.
Figure 89:
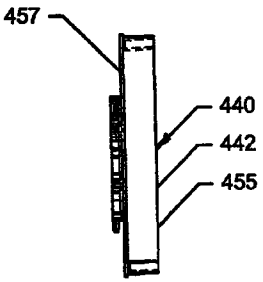
FIG. 89 is a right side elevation of the rail of FIG. 88.
Figure 88:
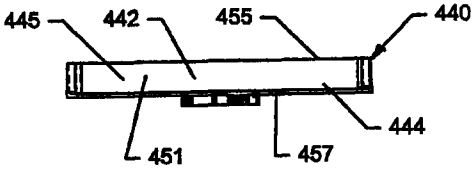
FIG. 88 is a top plan view of the rail of the display of FIG. 86.

FIGS. 87A and 87B show a leg and rail assembly of a fourth embodiment of the display 410. While the left side rail is shown, those skilled in the art would understand that the right side would be a mirror image thereof, and this is not separately described. The leg 420 can be configured as a C-channel similar to the leg 20 discussed above and shown in FIGS. 7-17, and parts of it have been broken away here for clarity in viewing the engagement of the rails 440. The rail 440 is shown in detail in FIGS. 88-90A and 90B. As shown, the rail 440 includes body 442 having a front and rear edges 450, 452, an inner face 455 that faces inward the with respect to the display 410 when assembled and an outer face 457 that faces outward with respect to the display 10 when assembled. As shown, the front and rear edges 450, 452 are angled with respect to the top and bottom edges 451, 453, such that the body 442 substantially defines a parallelogram shape. First and second arms 444, 445 are aligned and extend from the front and rear edges 450, 452 of the body 442 in directions parallel to the top and bottom edges 451, 453. Longitudinal support wall 446 extends between the ends of arms 444, 445, as shown in FIG. 90A. The longitudinal support wall 446 is slightly angled with respect to the directions of the top and bottom edges 451, 453, such that it extends from a point 480 at an upper edge at a terminal end of the first arm 444, to a point 482 lower edge at a terminal edge of the second arm 445, as shown in FIG. 90A.

Stop walls 448 are provided at the ends of arms 444, 445, as shown in FIG. 90A. The stop walls 448 each extend between a respective arm 444, 445 and the support wall 446, and serve to block a sample 2 supported by the rail 440 from sliding off of the support wall 446. Due to the extension of the support wall 446 between points 480 and 482, the two stop walls 448 extend in opposite directions with respect to the support wall 446, with the stop wall 448 of arm 444 extending upward with respect to support wall 446 and stop wall 448 of arm 445 extending downward with respect to support wall 446 when the rails 440 are positioned as shown in FIGS. 87A and 88-90. The reverse is true for at least some of rails 440 that are inverted, as shown in FIG. 87B. However, in both configurations the stop wall 448 extends upward with respect to the support wall at whichever point 480, 482 is situated lower. This permits the edge of a sample 2 to be seated on the support wall in either configuration.

The rails 440 further include guides 454. As shown in FIGS. 87A, 87B and 90, the guides 454 each project from the outer face 457 of a respective rail 440 and are received by the "C" shaped channels of the rails 440. The guides 454 include first projecting members 456 and second projecting members 458. As shown in FIG. 90A, the first projecting member 456 is located on the outer face 457 proximate to the first arm 444, and second projecting member 458 is located on the outer face 457 proximate to the second arm 445. The second projecting member 458 is confined between the top and bottom edges 451, 453 of the body 442, whereas the first projecting members 456 includes upper and lower extensions 490, 491 that extend past edges 451, 453. The first projecting members 456 further include portions 492 that extend on the outer face 457 towards arm 444.

The guides 454 allow the rails 440 to be slidably inserted into the "C" shaped channels of the rails 440 and stacked in two configurations. According to the first configuration, shown in FIG. 87A, the first arms 444 are angled downwards and the second arms 445 angled upwards. The first projecting members 456 of the guides stack on top of each other, with a lower extension 491 of each rail 440 resting on top of the upper extension 490 of a rail 440 located directly below. The upper and lower surfaces of the upper and lower extensions 490, 491 are complementary to permit secure engagement of the guides and stacking of the rails.

According to the second configuration, shown in FIG. 87B, the stacked rails 440 are alternatingly inverted. As shown, the upper extension 490 of the uppermost rail 440 now extends downward, as the rail 440 has been inverted, and into a space 493 defined between the first and second projecting members 456, 458 (FIG. 90A) of the rail 440 directly below. The portion 492 extending towards arm 444 of the upper rail 440 rests on the second projecting member 458 of the lower rail. The upper and lower surfaces of the projecting members 456, 458 are configured to be complementary in this configuration as well. As shown in FIG. 87B, due to the interlocking of the projecting members 456, 458, a greater number of rails 440 can be stacked according to this configuration compared with that shown in FIG. 87A. This results in the samples held on the support walls 446 being held closer together for a different aesthetic appeal.

Figure 91C:
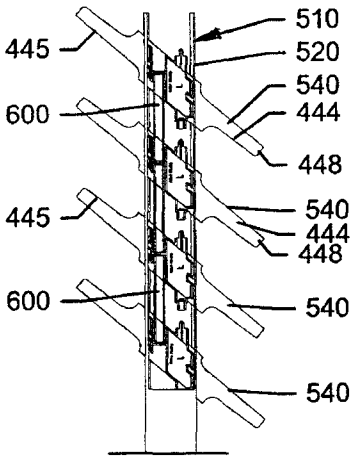
FIGS. 91A-91C are views similar to FIGS. 87A and 87B showing an alternate reversible rail shown in conjunction with a cascading rail as well as a spacer to provide a number of spacing options for the display system.
Figure 91B:
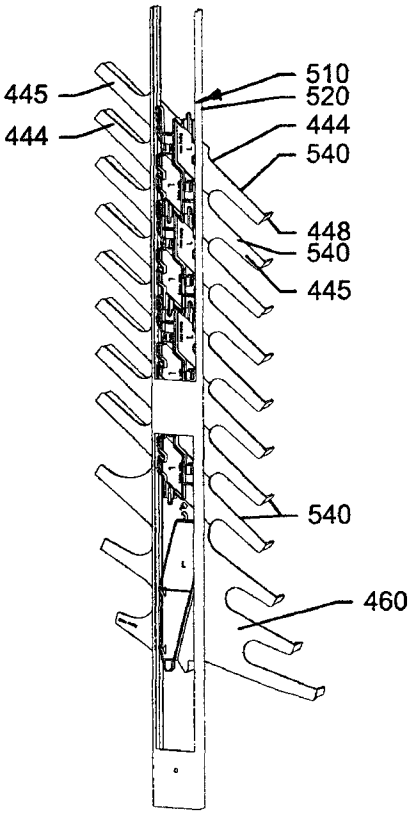
Figure 91A:
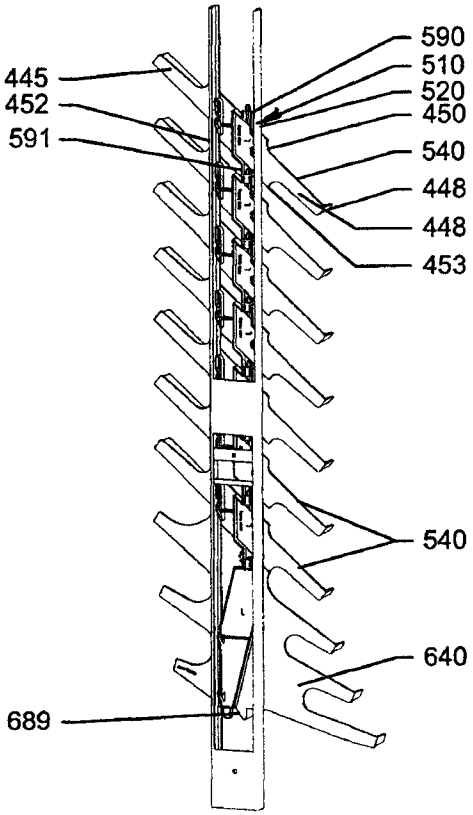

FIGS. 91A-91C show various configurations of a fifth embodiment of the display 510. While the left side rail is shown, those skilled in the art would understand that the right side would be a mirror image thereof, and this is not separately described. The leg 520 can be configured similar to the leg 20 discussed above and shown in FIGS. 7-17, and part of it is broken away in order to more clearly see the engagement of the rails 540. The rail 540 is shown in detail in FIGS. 92A, 92B, 93A, 93B and 94 is a modified embodiment of the rail 440 and can be used in connection with a cascading rail 640, shown in detail in FIGS. 96A, 96B, 97A, 97B and 98 and/or a spacer 600, which can be provided in different lengths, to allow a variable spacing between the rails 540.

The rails 540 are the same as the rails 440 and identical elements are identified with the same reference numerals. Similar elements are identified with reference numerals that are increased by 100 from the similar element of the rail 440. The differences are described below. In the rail 540, the first projecting member 556 includes an upper extension 590 that ends in a receptacle 592 having a protruding tab 593 that is adapted to receive a lower extension 591 of a next adjacent rail 540, which includes a slot 597 to receive the protruding tab 593. Additionally, an intermediate wall 595 extends between the between the first projecting member 556 and the second projecting member 558. This defines upper and lower pockets 596 and 598. The spacer 600 is adapted to snugly fit into each pocket 596, 598, and different length spacers can be provided in order to vary the spacing between the rails 540 from the standard spacing provided by the lower extension 591 of one rail 540 being received in the receptacle formed by the upper extension 590 of the preceding rail. For this embodiment again, only the left side rail 540 has been shown, and the right side rail would be a mirror image thereof. The rail 540 is used in the same manner as the rail 440, and allows for different spacing between the rails. FIG. 91A shows the rails 540 with a first standard spacing. FIG. 91B shows the spacing of the rails 540 is a more closely spaced configuration, which is achieved by installing every other rail 540 in an inverted position with the arm 445 facing downwardly. FIG. 91C shows an increased spacing between the rails 540 that is created using the spacers 600.

An advantage of the rail 540 is that it does not have to be slid down from the open top of the C-channel that defines the leg 520. It can also be installed by placing the rail 540 into the channel with the downward facing arm 444, 445 tilted further downward so that the projecting members 556, 558 are received within the C-channel of the leg 520, the rail 540 is then tilted back so that the gaps 572 defined by the projecting members 556, 558 engage the lips of the C-channel that defines the leg 520. The rail 540 can then be slid down only a short distance so that the lower extension 591 engages the upper extension 590 of a previously installed rail 540.

Figure 95B:
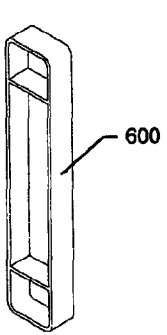
FIG. 95B is a rear perspective view of the spacer of FIG. 91C.
Figure 95A:
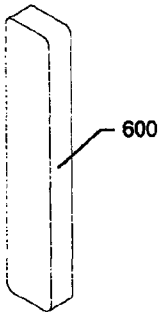
FIG. 95A is a front perspective view of the spacer in FIG. 91C.
Figure 92A:
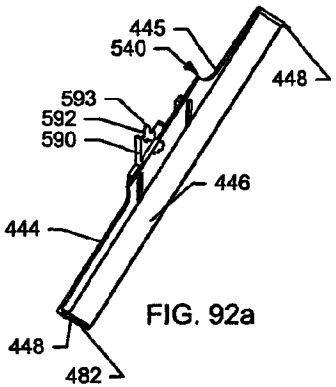
FIG. 92A is a front perspective view of the rail of FIGS. 91A-91C.
Figure 93A:
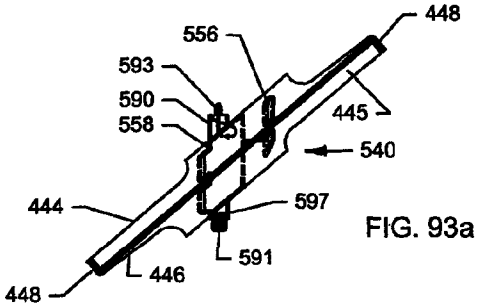
FIGS. 93A and 93B are front and rear views of the rail of FIG. 92A.
Figure 92B:
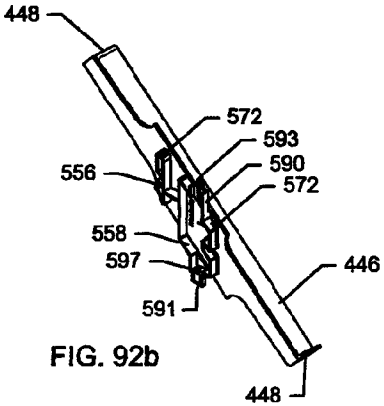
FIG. 92B is a rear perspective view of the rail of FIG. 92A.
Figure 94:
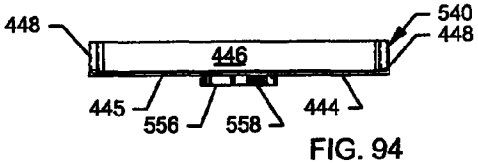
FIG. 94 is a top view of the rail taken from FIG. 93B.
Figure 93B:
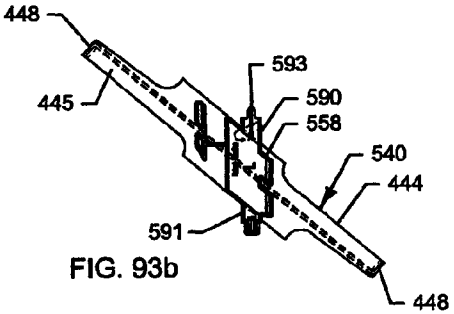

FIGS. 95A and 95B show the spacer 600 in detail.

FIGS. 96A, 96B, 97A, 97B and 98 show the cascading rail 640 that provides a variable spacing and pitch of the arms 644 to provide a unique display appearance, which is especially effective at the bottom of a display. The cascading rail 640 is similar to the rail 140, except that it includes 3 pairs of the arms 644 on the body 642 with support walls 646 extending across each pair of the arms 644. A stop wall 648 is located at the lower end of each pair of arms 644. A guide 654 for engaging the cascading rail 640 to the C-shaped posts that define the leg 520 is located on the back of the cascading rail 640 and includes protruding guide walls 656, 658 and protruding portions 670 that define gaps 672, similar to the gaps 72 above, that allow the cascading rail to engage the posts or leg 520. Transverse walls 659 extend between the guide walls 656, 658. The arrangement shown in FIGS. 96B and 97B of the protruding portions 670 allows the cascading rail 640 to not only be installed by being slid down from the open top of a C-channel post 24, but also allows it to be installed at an intermediate position by tilting the forward arms 644 downwardly, and placing the guide 654 inside the C-channel, and then tilting the forward arms 644 up so that the gaps 672 engage the lips of the C-channel post 520. Portions of the guide walls 656, 658 are angled to allow for this type of installation.

Figure 96B:
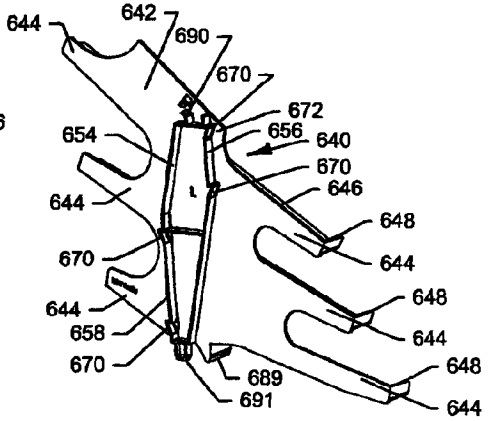
FIGS. 96A and 96B are front and rear perspective views of the cascading rail shown FIGS. 91A and 91B having 3 tiers.
Figure 96A:
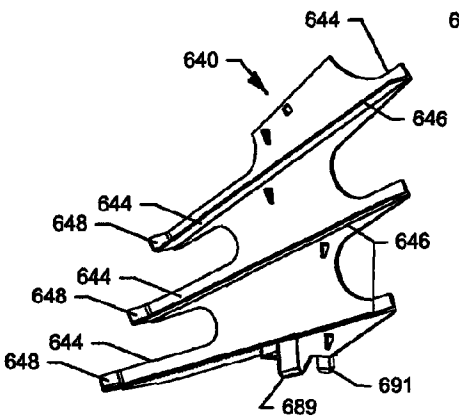
Figure 97B:
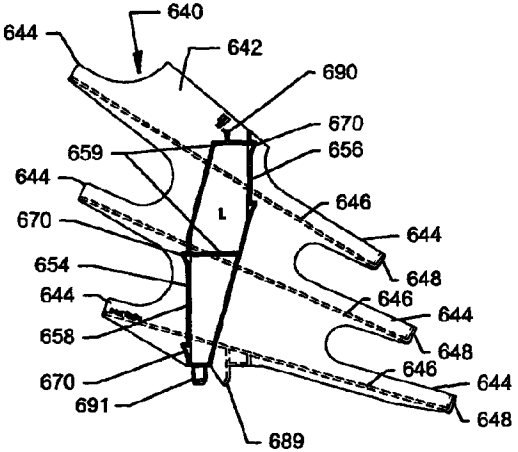
FIGS. 97A and 97B are front and rear views of the cascading rail shown
Figure 97A:
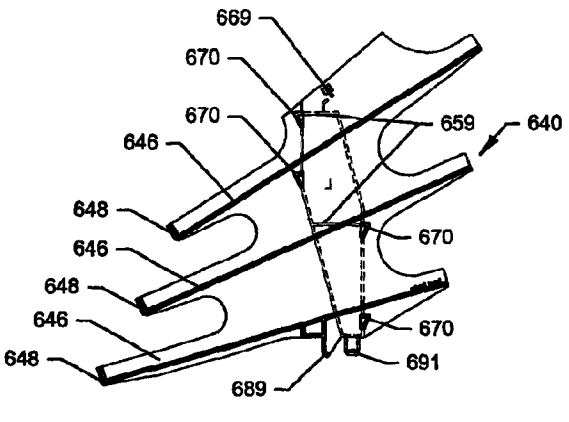
Figure 98:
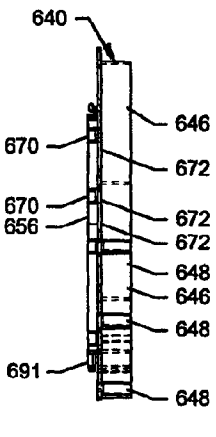
FIG. 98 is a side view of the cascading rail taken from FIG. 97A.
Figure 100:
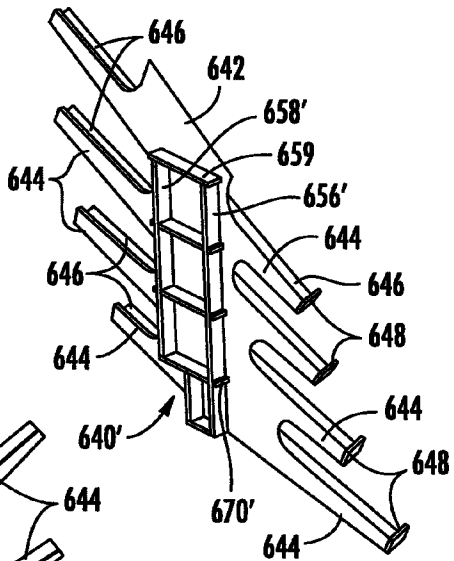
FIG. 100 is a rear perspective view of the cascading rail of FIG. 99.
Figure 101:
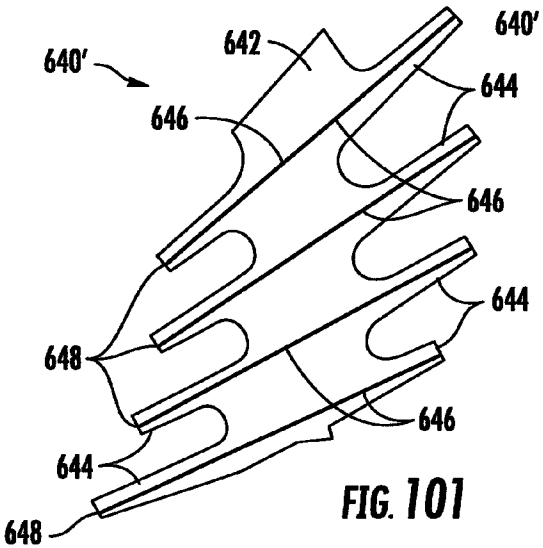
FIG. 101 is a front view of the cascading rail of FIG. 99.
Figure 99:
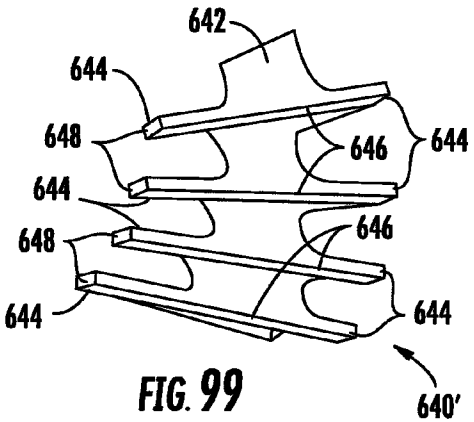
FIG. 99 is a front perspective view of another embodiment of a cascading rail having 4 tiers for supporting articles to be displayed.
Figure 102:
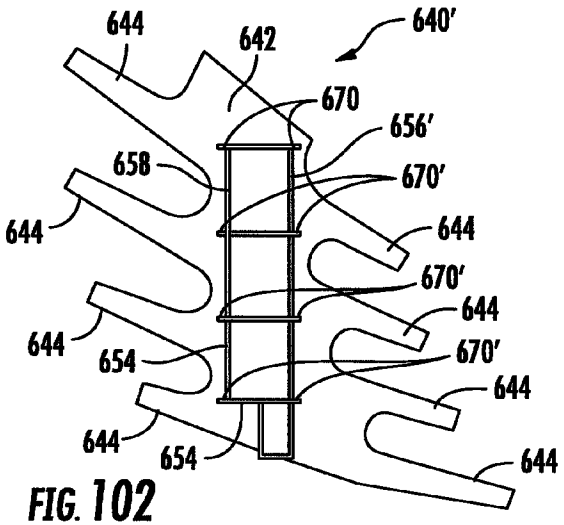
FIG. 102 s a rear view of the cascading rail of FIG. 99.
Figure 103:
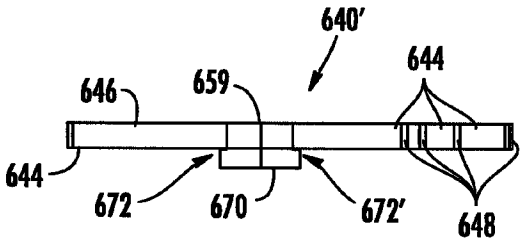
FIG. 103 is a top view of the cascading rail taken from FIG. 102.

As shown in FIGS. 91A, 96A and 97A, preferably the lowermost arm 644 extends further forward and is set at the lowest angle in comparison to the arms 644 above it. This provides a particularly effective display for articles at the bottom of the display system(s) according to the invention. A lower extension 691 can be provided for engagement in a base of the display. Alternatively, a lower protrusion 689 can engage over or behind a vertical brace 280, as shown in FIG. 91A. An upper engagement structure 690 is also provided that is adapted to receive the lower engagement structure of a next adjacent rail, such as the rail 540 as shown in FIG. 91A. A clasp 669, similar to clasp 69 above, is preferably also provided at the upper edge to engage the bottom of a next adjacent rail, such as rail 540. Here, only the left side cascading rail 640 has been shown, and the right side rail would be a mirror image thereof. Additionally, the rail 640 is preferably also a molded polymeric part formed in one piece in a similar manner to the other rails described above. While a preferred cascading arrangement has been shown, other arrangements could be provided by varying the pitch, forward spacing (which determines the reveal length for the item being displayed) and angles of the arms 644.

FIGS. 99-103 show another embodiment of the cascading rail 640', which is similar to the cascading rail 640, except that it includes 4 pairs of the arms 644. Additionally, the guide walls 656' and 658' are parallel along their full length and include equally spaced protruding portions 670' that define the gaps 672' to engage the C-channel posts 24. This configuration requires that the cascading rail 640' is installed from the open top of the C-channel post or leg 520, and slid down rather than being installable by tilting the arms down and placing it in the c-channel and then tilting it back so that the gaps 672 engage the lips of the c-channel, which is possible with the configuration of the cascading rail 640 described above.

Figure 67:
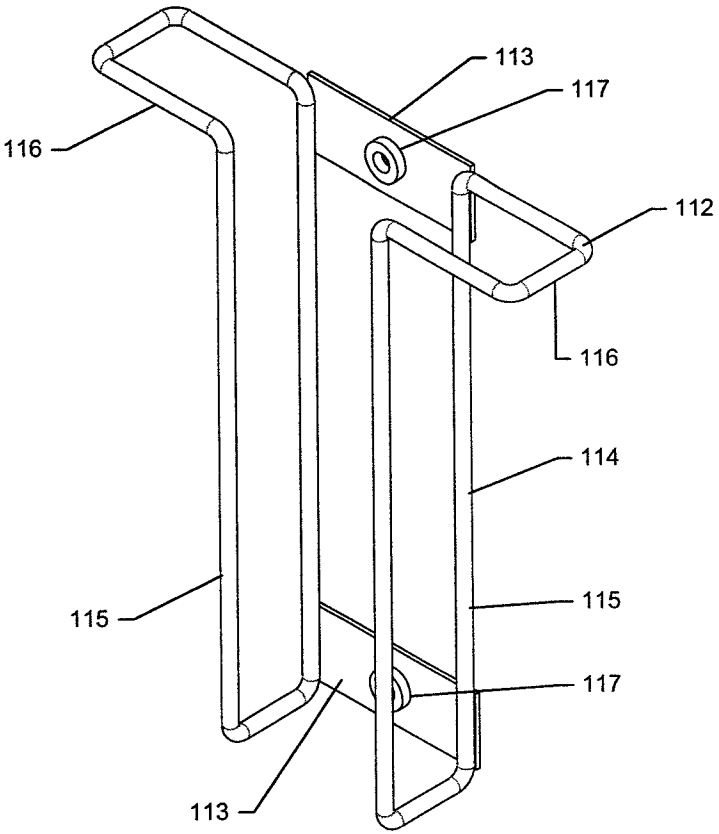
FIG. 67 is a front perspective view of a storage pocket of the display.

FIG. 67 shows a storage pocket 112 that may be included with any of the above described embodiments of the display 10, 210, 310, 410. As shown, the pocket 112 includes upper and lower panels 113 and a wire frame 114. The frame 114 is formed of two wire segments 115. Each of the segments 115 is formed into a loop having a generally rectangular shape. An upper portion 116 of each segment is bent to give the loop an "L" shaped profile. The two segments 115 are then oriented parallel to each other with the upper portions 116 extending in opposite directions. Opposite edges of the panels 113 are then attached to the segments 115 at the parallel extending portions thereof. The panels 113 include holes 117 that can receive fasteners to attach the pocket 112 to a display 10, 210, 310, 410, for example, by fastening the pocket 112 to the leg

20, 220, 320, 420. The pocket 112 may be used to hold materials such as literature regarding the product held by the display.

Figure 104:
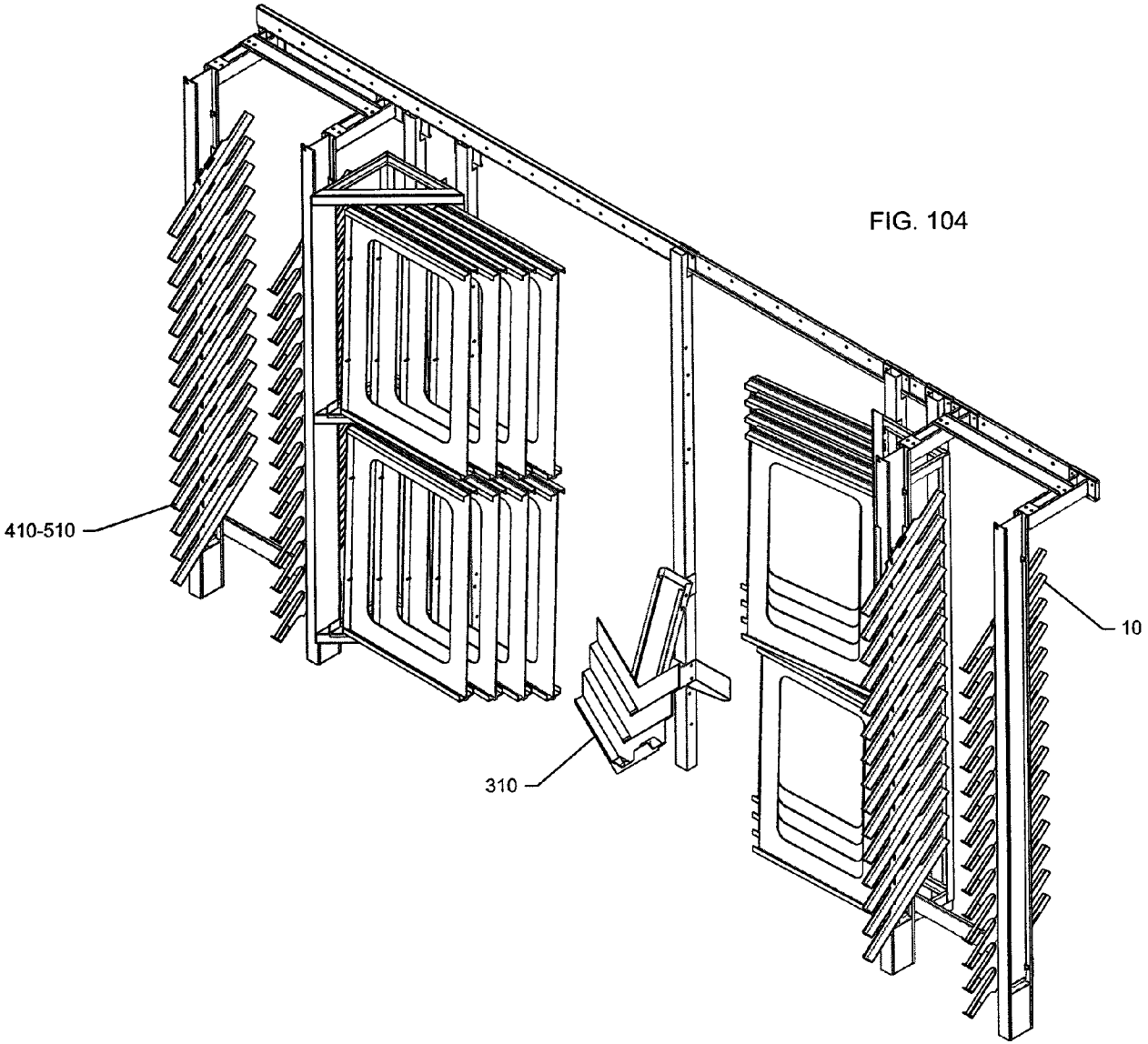
FIG. 104 is a front perspective view of a display including multiple units of the different embodiments of the invention.
Figure 105:
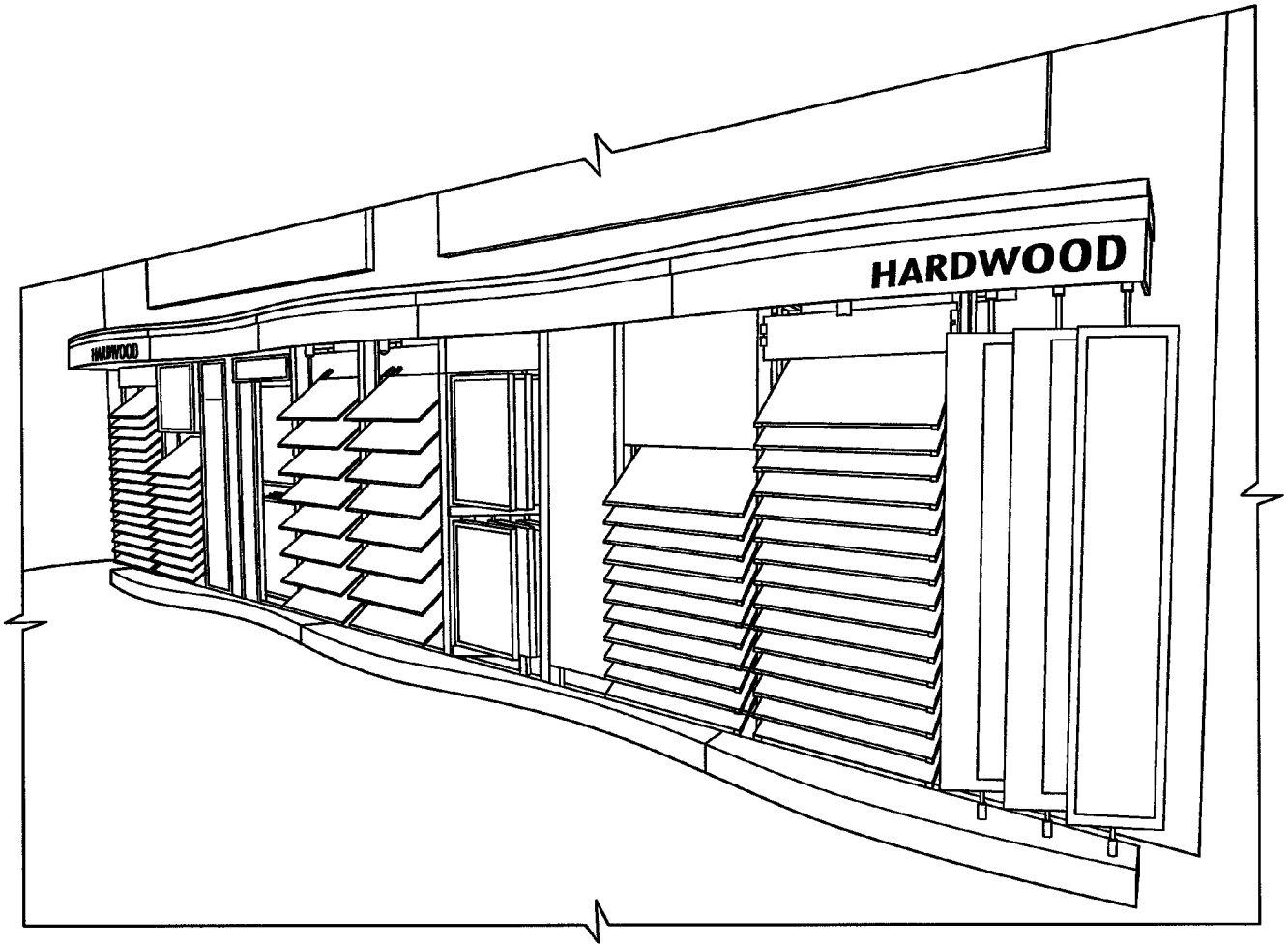
FIGS. 105-114 show various perspective views of displays including multiple units of the different displays of the invention.
Figure 106:
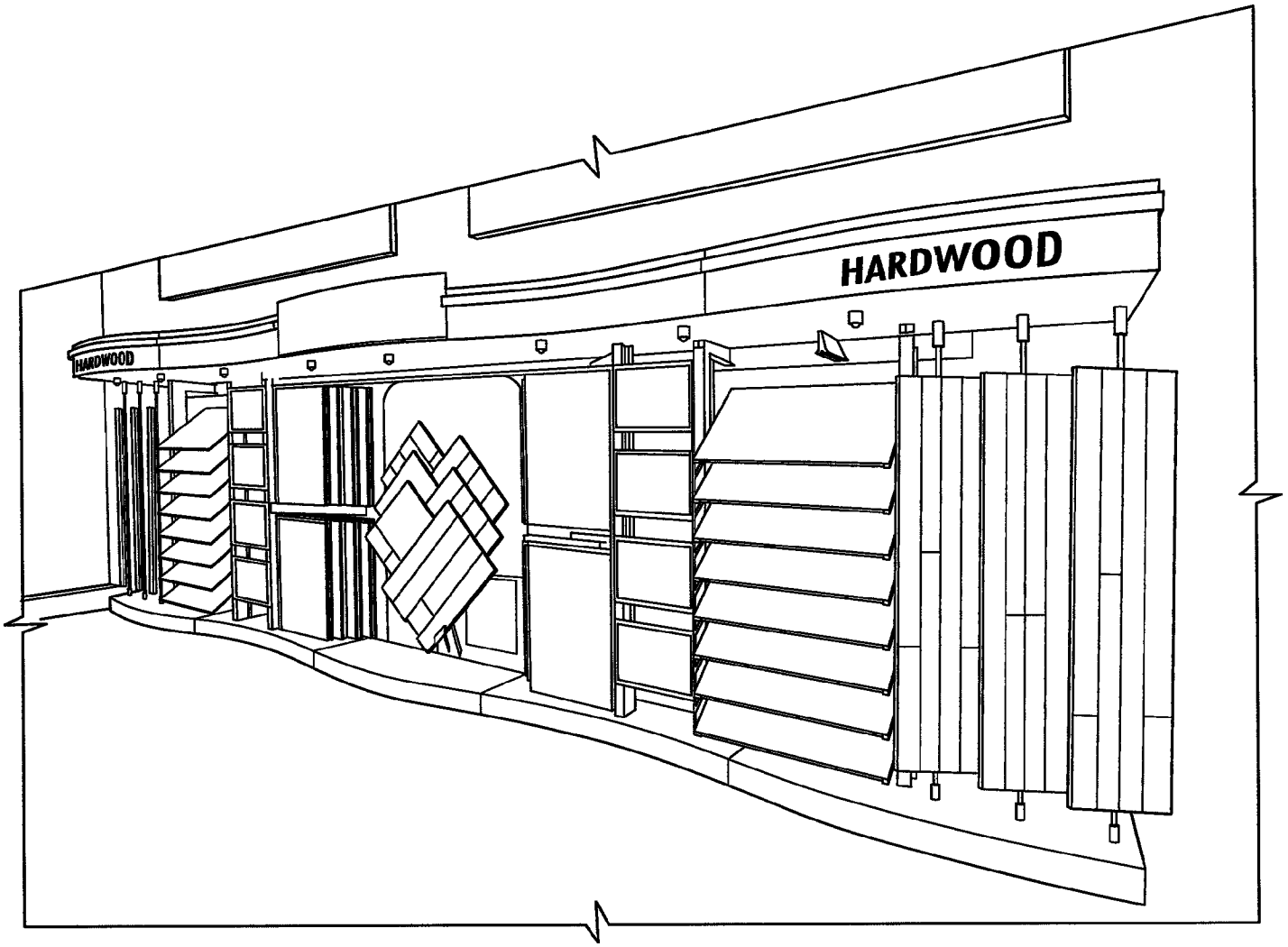
Figure 107:
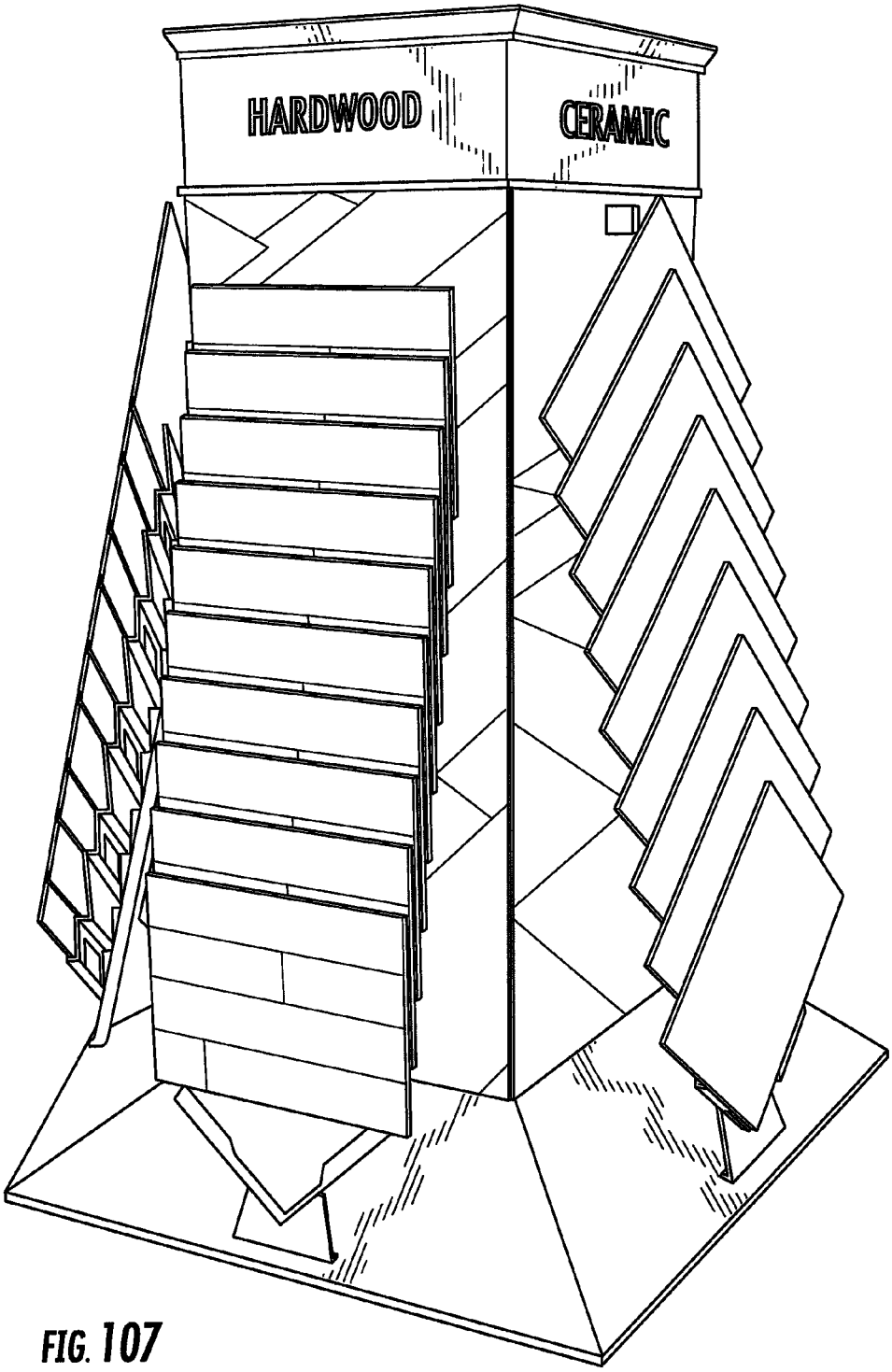
Figure 108:
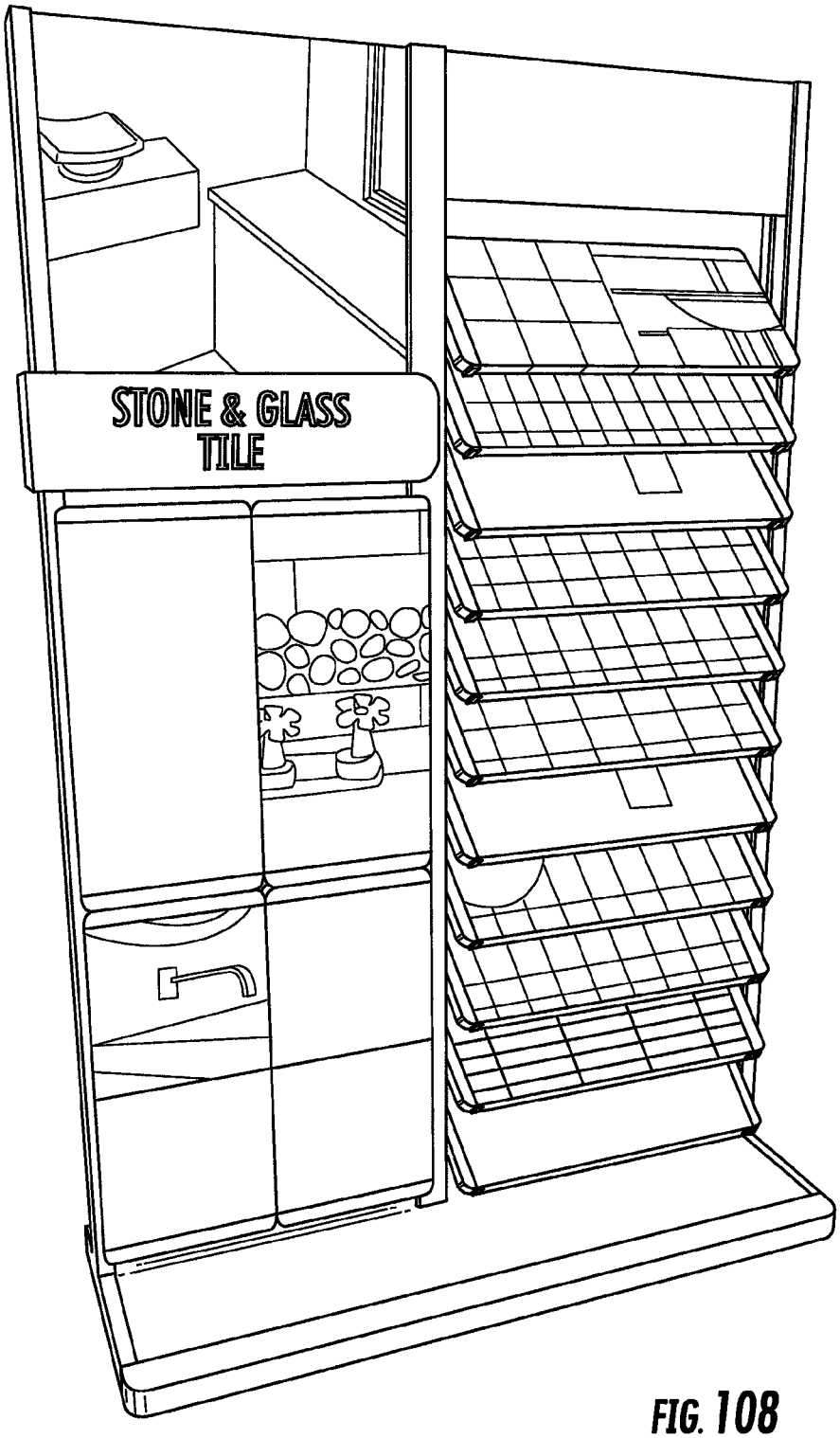
Figure 109:
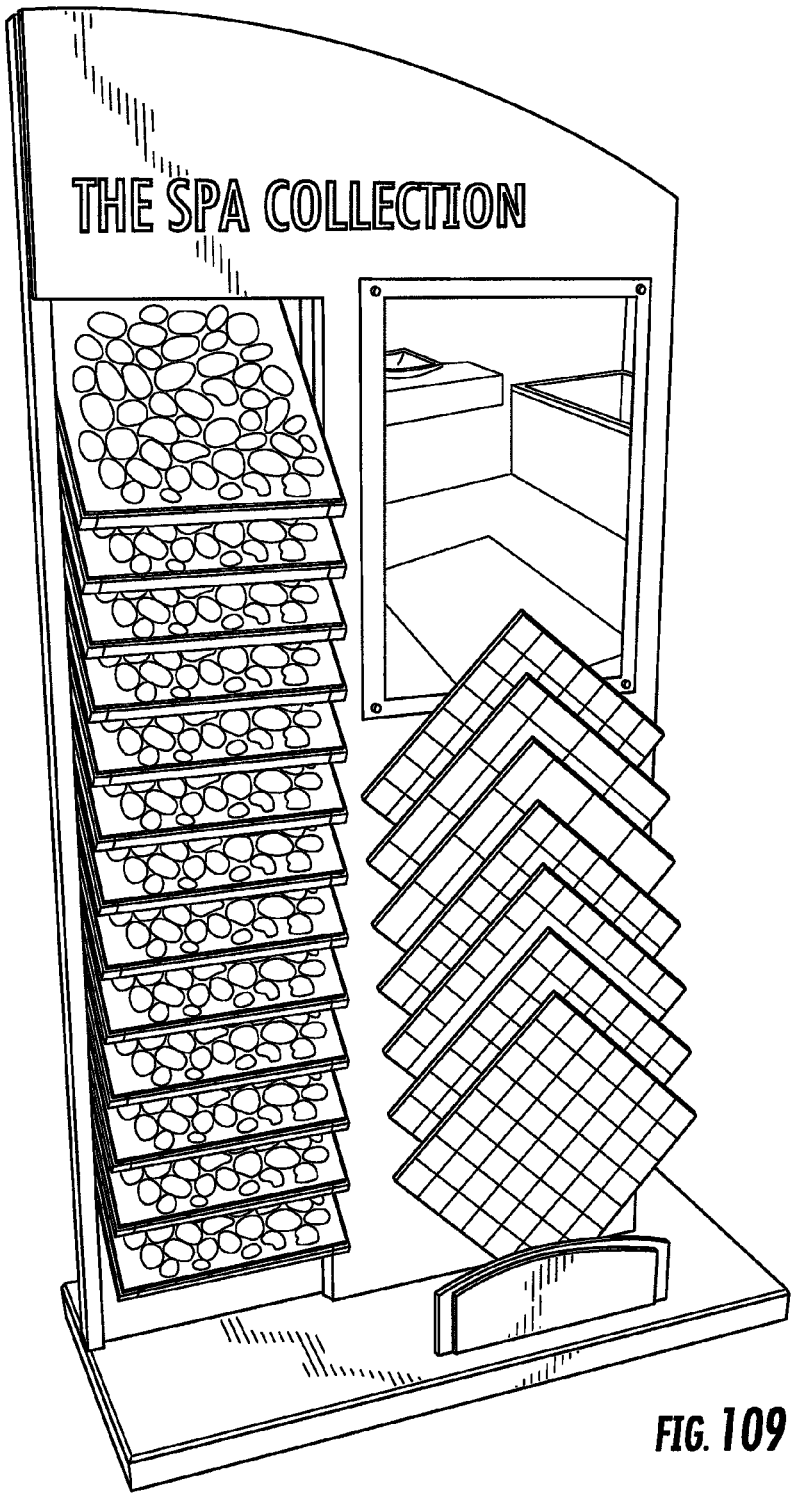
Figure 110:
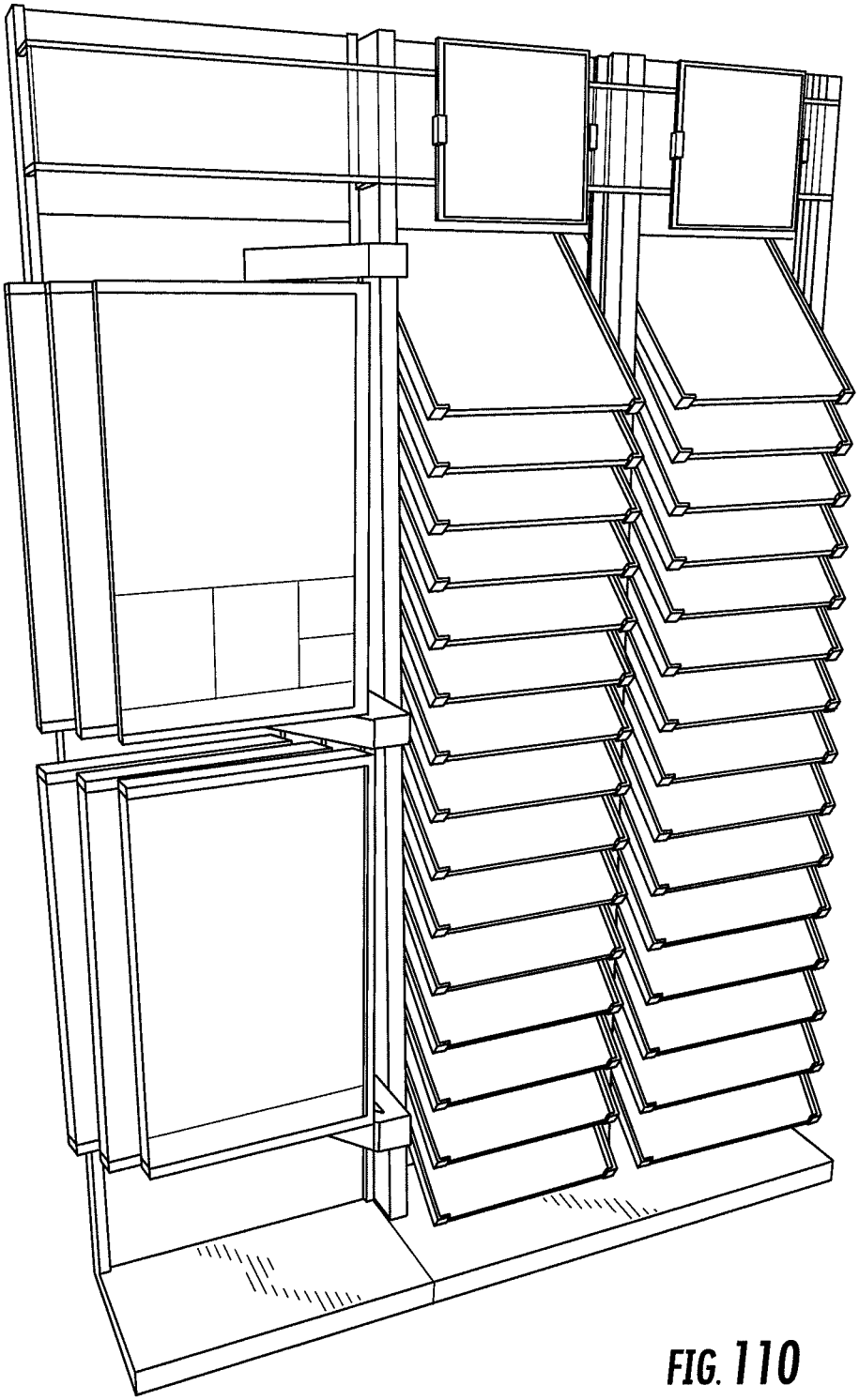
Figure 111:
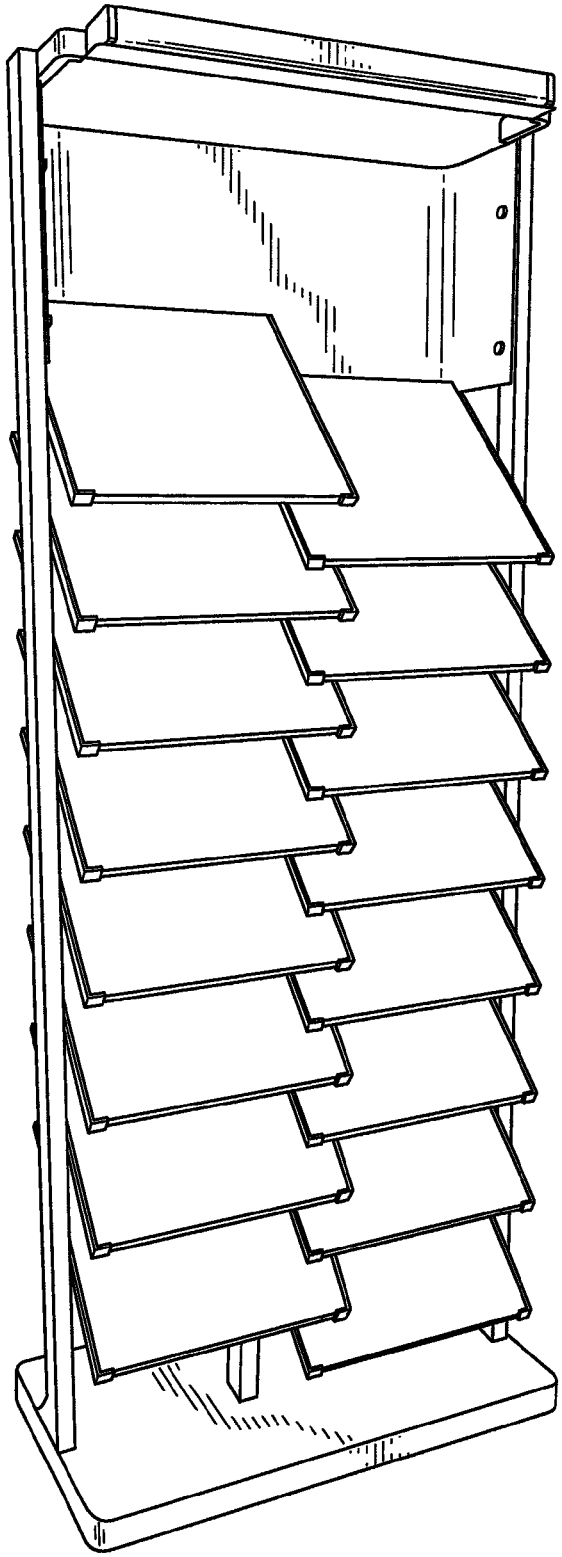
Figure 112:
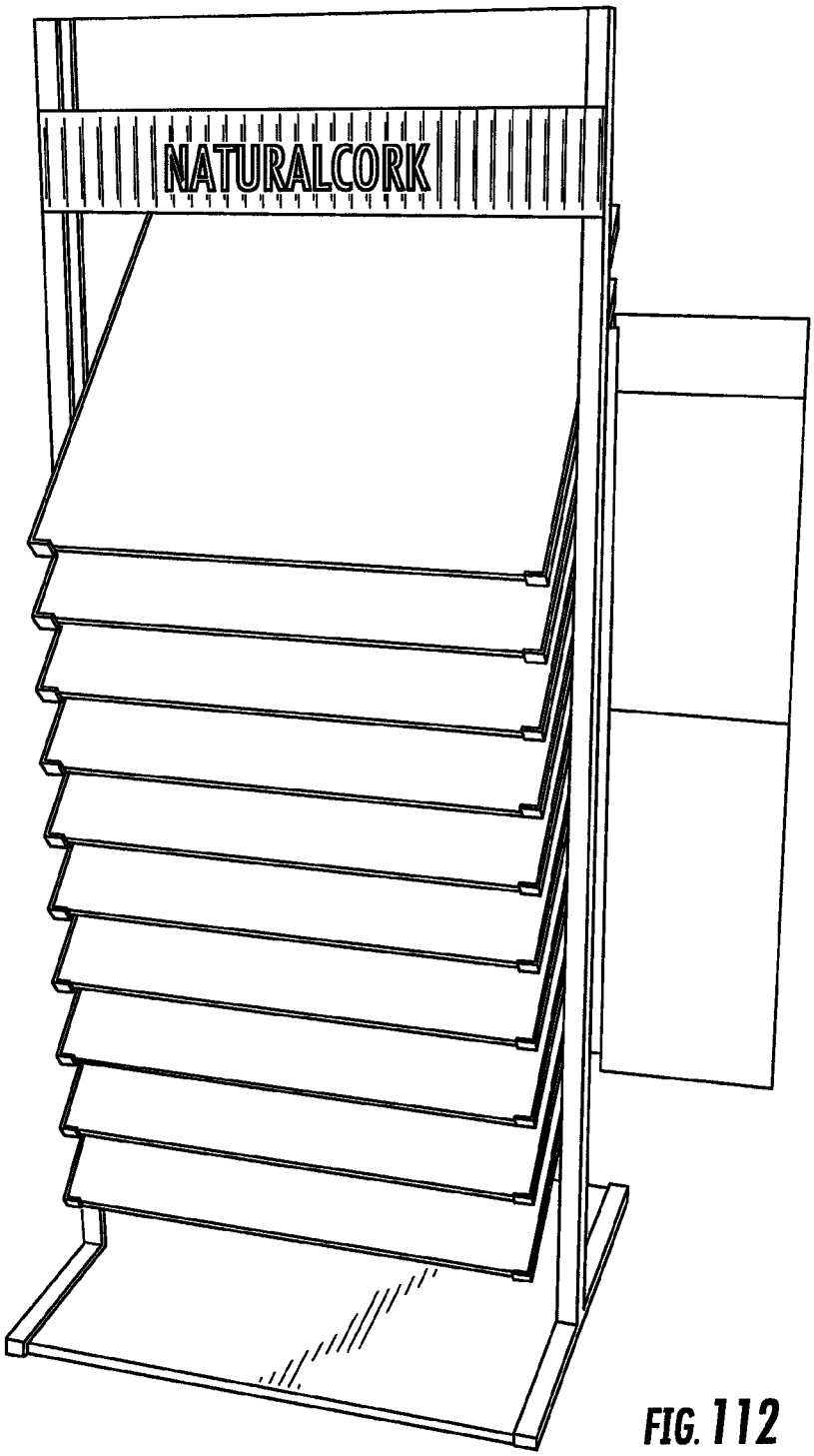
Figure 113:
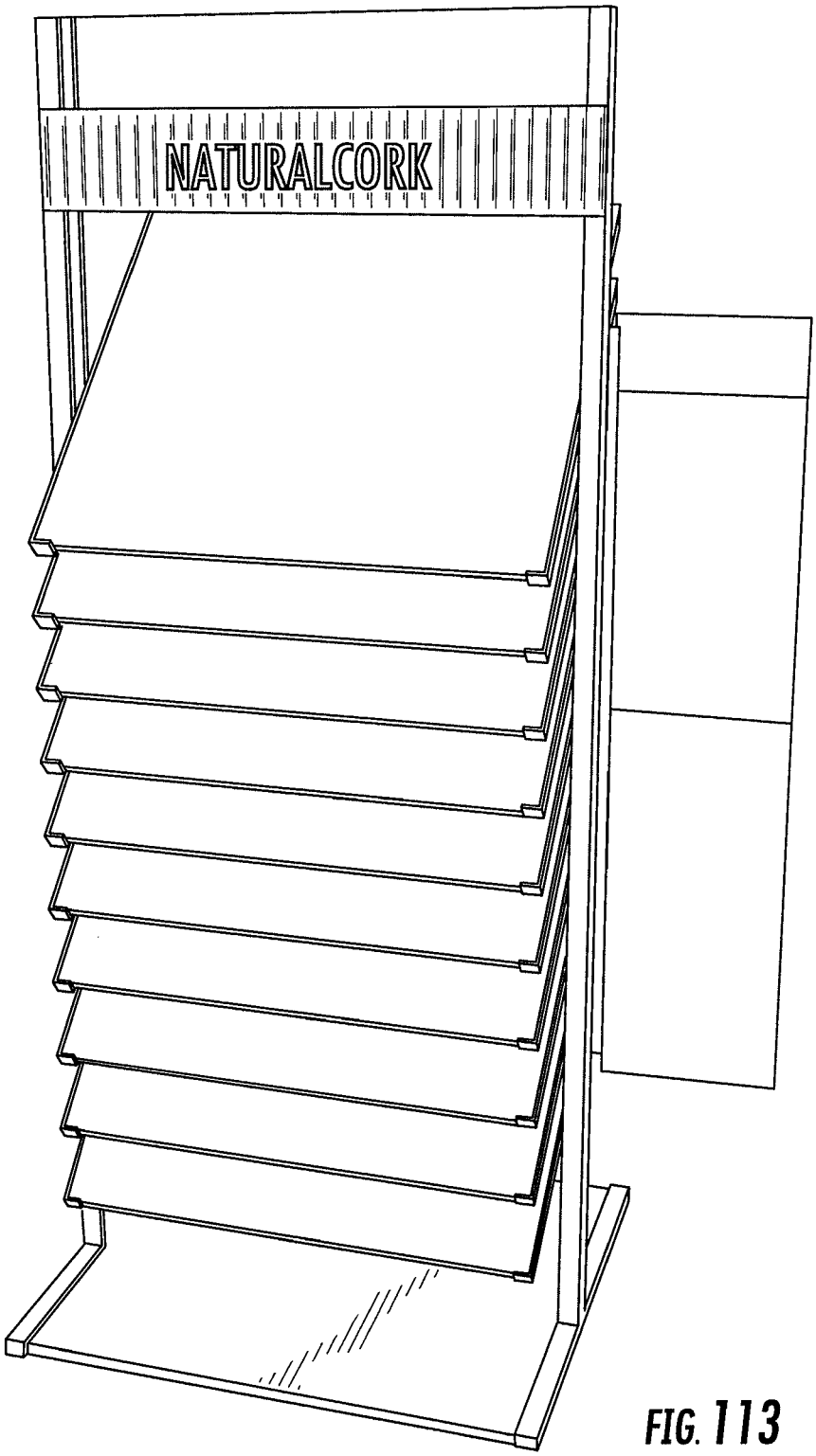
Figure 114:
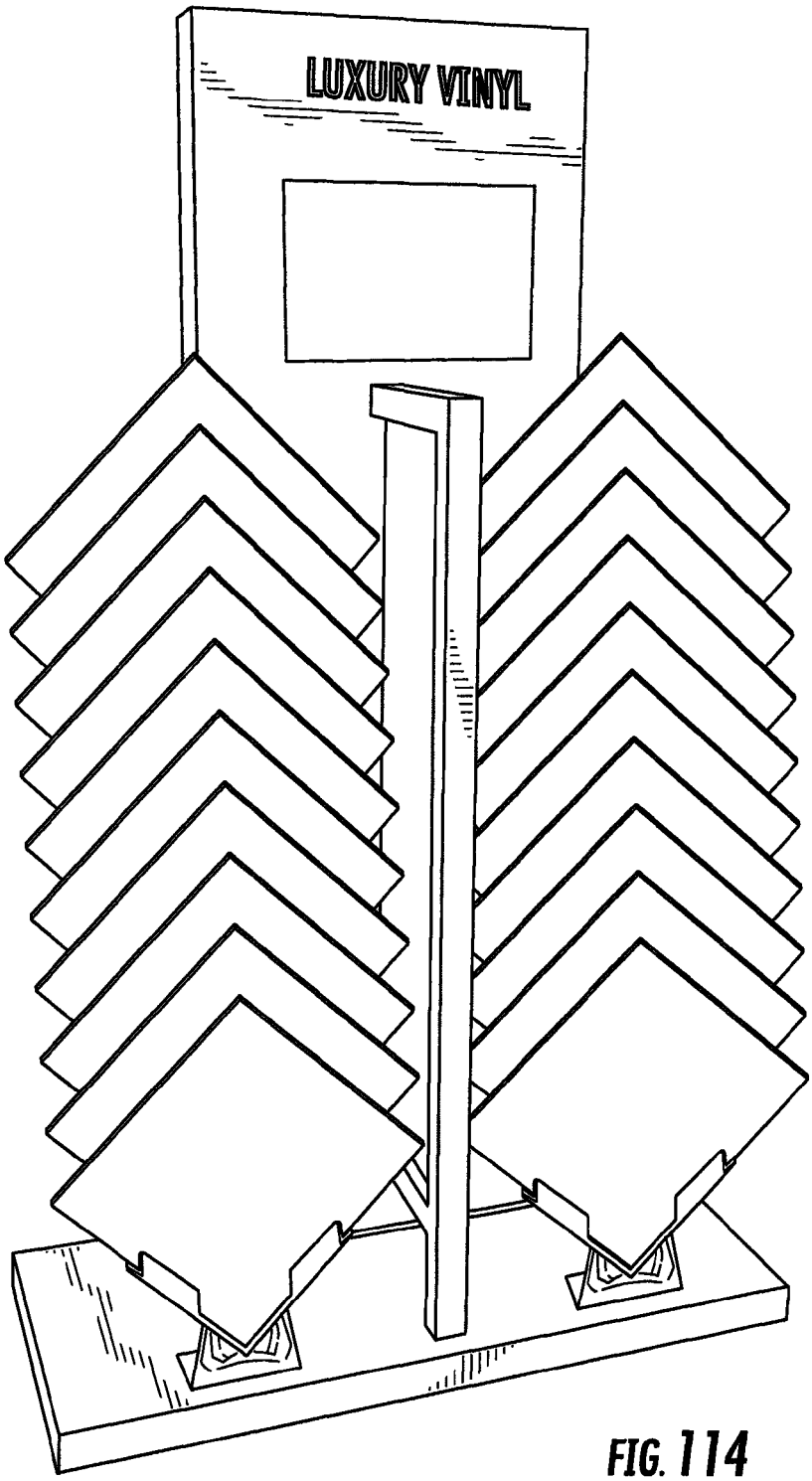

FIG. 104 shows a multi-unit display, including various display embodiments described above, as well as a winged unit. Each of the displays described above can be combined with each other as well as other types of displays in any number of ways. Some alternative combinations using the embodiments described above are shown in FIGS. 105-114.

While the preferred embodiments of the invention have been described in detail above, the invention is not limited to the specific embodiments described which should be considered as merely exemplary.

What is claimed is:

1. A display system comprising:

a first C-channel and a second C-channel, each having a pair of inwardly extending lips;

a plurality of rails having engagement structures that are engaged within the first or the second C-channels, the engagement structures engaged with the lips;

a support on which the first and the second C-channels are arranged, with the first C-channel facing the second C-channel, and the plurality of rails including left hand rails and right hand rails, each having support structures for the display of flat goods, the left hand rails being engaged within the first C-channel and the right hand rails being engaged within the second C-channel, the rails each including arms that extend from front and rear edges of a body of respective ones of the left and right hand rails, the arms of opposing ones of the left and right hand rails being arranged in generally aligned pairs, and a support wall extending on the body and across the arms of each of the left and right hand rails, the support walls of aligned ones of the left hand and right hand rails defining a support plane for an article to be displayed, and stop walls being located at front ends of the arms; and a plurality of planar material samples to be displayed, each resting directly on the support walls of respective opposing pairs of the left and right hand rails and against the stop walls at the front ends of the arms such that the planar material samples to be displayed can be manually lifted from and placed back in the display system.

2. The display system of claim 1, wherein each of the left hand rails and the right hand rails includes at least two pairs of the arms.

3. The display system according to claim 1, wherein the arms are arranged at a downward angle relative to the C-channels.

4. The display system of claim 1, wherein each of the rails comprises a single pair of arms, and a back of each or the rails includes guide walls that have protruding portions that extend outwardly therefrom to define gaps between the protruding portions and the back of the rail, and the gaps are engaged by the lips of the C-channel.

5. The display system of claim 4, wherein the rails are installable in a first orientation on the C-channels to define a first spacing between adjacent ones of the rails, or in a second orientation to define a second spacing, different than the first spacing, between adjacent ones of the rails.

6. The display system of claim 5, wherein the stop wall is located on an end of each of the arms, and in the first orientation, a first surface of the support wall is adapted to support the planar material sample to be displayed, and in the second orientation, a second surface of the support wall is adapted to support the planar material sample to be displayed.

7. The display system of claim 4, wherein the protruding portion includes upper and lower pockets for receiving a spacer, and a spacer is located in the pockets of adjacent ones of the rails in order to vary a spacing between the rails.

8. The display system of claim 1, wherein a plurality of the arms are located on each of the left hand and the right hand rails, and the arms on a respective one of the rails are arranged at different angles relative to one another.

9. The display system of claim 8, wherein at least one of the arms on respective ones of the left hand and the right hand rails extends further out from a front edge of the body, in order to provide a greater reveal spacing from another one of the arms on the respective rails.

10. The display system of claim 1, wherein the rails are slidably engaged with the C-channels.

11. The display system of claim 1, wherein each of the rails further includes a clasp in proximity to an upper edge of the body and a lower wall arranged on a back of the body, and the clasp engages the lower wall of a next adjacent one of the rails.

12. The display system of claim 1, wherein the first and second C-channels are generally vertically installed on the support, and the arms are set at an angle of 30° to 60° from horizontal.

13. The display system of claim 1, further comprising a header connected between tops of the first and second C-channels.

14. The display system of claim 1, wherein each of the rails is molded from a polymeric material.

* * * * *